US006089469A

United States Patent [19]

Fusama et al.

[11] Patent Number: 6,089,469

[45] Date of Patent: Jul. 18, 2000

[54] VISCOUS FLUID SUPPLY CONTROL APPARATUS AND METHOD THEREOF

[75] Inventors: Masaki Fusama, Kobe; Osamu Nakagawa, Hyogo; Hideki Satou, Kobe, all of Japan

[73] Assignee: Kawasaki Jukogyo Kabushiki Kaisha, Kobe, Japan

[21] Appl. No.: 09/109,730

[22] Filed: Jul. 2, 1998

[30] Foreign Application Priority Data

Jul. 4, 1997 [JP] Japan ..... 9-180073

[51] Int. Cl.[7] ..... B67D 5/08

[52] U.S. Cl. ..... 239/71; 239/99; 239/124

[58] Field of Search ..... 239/71, 75, 99, 239/101, 124, 127

[56] References Cited

U.S. PATENT DOCUMENTS

| | | | |
|---|---|---|---|
| 4,274,380 | 6/1981 | De Vulpillieres | 239/127 X |
| 4,585,169 | 4/1986 | Kinsey | 239/75 |
| 4,848,657 | 7/1989 | Hashimoto et al. | 239/71 X |
| 5,048,754 | 9/1991 | Rich | 239/75 X |
| 5,312,042 | 5/1994 | Larson | 239/124 X |
| 5,397,054 | 3/1995 | Ziegs | 239/124 X |

FOREIGN PATENT DOCUMENTS

| | | |
|---|---|---|
| 62-19280 | 1/1987 | Japan . |
| 62-109846 | 7/1987 | Japan . |
| 63-111963 | 5/1988 | Japan . |
| 63-502568 | 9/1988 | Japan . |
| 2-160073 | 6/1990 | Japan . |
| 3-15678 | 2/1991 | Japan . |
| 3-123557 U | 12/1991 | Japan . |

*Primary Examiner*—Lesley D. Morris
*Attorney, Agent, or Firm*—Oliff & Berridge, PLC

[57] ABSTRACT

A viscous fluid supply control apparatus reduces a difference between a primary side pressure of a feeding pump and a secondary side pressure thereof to lessen an internal leak of the feeding pump. The viscous fluid supply control apparatus comprises a viscous fluid supply source, a discharge nozzle for discharging a viscous fluid, a feeding pump for feeding the viscous fluid from the viscous fluid supply source to the discharge nozzle, a first pressure sensor for detecting the primary side pressure of the feeding pump, a second pressure sensor for detecting the secondary side pressure of the feeding pump, and pressure regulation control means for controlling actuation of pressure regulating means regulating the primary side pressure based on detection values obtained by the first and second pressure sensors. The pressure regulation control means controls the actuation of the pressure regulating means such that the primary side pressure of the feeding pump converges on the secondary side pressure thereof.

17 Claims, 9 Drawing Sheets

PRIOR ART

VISCOUS FLUID SUPPLY CONTROL APPARATUS AND METHOD THEREOF

FIELD OF THE INVENTION

The present invention relates to an apparatus and method for controlling supply of a viscous fluid to be fed from a viscous fluid supply source to a discharge nozzle.

DESCRIPTION OF THE RELATED ART

For example, Japanese Utility Model Laid-Open Publication No. Hei 3-123557 has disclosed a viscous fluid supply control apparatus. The known supply control apparatus has a basic structure shown in FIG. 10, for example, which comprises a viscous fluid supply source 2 for supplying a viscous fluid such as a coating material, a discharge nozzle 4 for discharging the viscous fluid, and a feeding pump 6 for feeding the viscous fluid from the viscous fluid supply source 2 to the discharge nozzle 4. The viscous fluid supply source 2 and the feeding pump 6 are connected through a first feeding passage 8. The feeding pump 6 and the discharge nozzle 4 are connected through a second feeding passage 10. The first feeding passage 8 is provided with a regulator 12 for controlling a pressure of the viscous fluid fed through the first feeding passage 8, that is, a feeding flow rate. The second feeding passage 10 is provided with a pressure detecting sensor 14 for detecting a pressure of the viscous fluid fed through the second feeding passage 10. A detection signal is sent from the pressure detecting sensor 14 to control means 16. The control means 16 controls actuation of the regulator 12 in response to the detection signal sent from the pressure detecting sensor 14. Consequently, the pressure of the viscous fluid fed through the first feeding passage 8 is controlled.

In such a known supply control apparatus, the pressure of the viscous fluid is controlled by a simple loop such that a pressure value of the viscous fluid in the second feeding passage 10, that is, an output value of the viscous fluid exactly acts as a pressure value of the viscous fluid in the first feeding passage 8, i.e., an input value of the viscous fluid. Accordingly, when a small amount of the viscous fluid is discharged from the discharge nozzle 4, the pressure of the viscous fluid in the feeding pump 6 is not greatly raised as shown in FIG. 11(*a*), for example. Therefore, the pressure of the viscous fluid in the second feeding passage 10 is not greatly raised so that a balance of the viscous fluid in the first and second feeding passages 8 and 10 is kept. However, if the amount of the viscous fluid discharged from the discharge nozzle 4 is increased, a rise in the pressure of the viscous fluid fed through the feeding pump 6 is also increased as shown in FIG. 11(*b*), for example. Therefore, the pressure of the viscous fluid in the second feeding passage 10 also tends to be raised. When the pressure of the viscous fluid in the second feeding passage 10 is thus raised, the control means 16 controls the regulator 12 such that the raised pressure acts as the pressure of the viscous fluid in the first feeding passage 8. Consequently, the rise in the pressure of the viscous fluid in the first and second feeding passages 8 and 10 is changed from a state shown by a solid line to a state shown by a broken line, and furthermore, to a state shown by a dashed line in FIG. 11(*b*). Thus, when the balance of the pressure of the viscous fluid is lost and the pressure of the viscous fluid is raised (or dropped), the pressure of the viscous fluid is exponentially increased (or exponentially reduced) so that the pressure of the viscous fluid in the first and second feeding passages 8 and 10 cannot be controlled.

In the viscous fluid supply control apparatus, if a temperature of the viscous fluid is changed, the amount of the viscous fluid discharged from the discharge nozzle is varied so that a predetermined amount of the viscous fluid cannot be discharged accurately. For example, the viscous fluid stays in the discharge nozzle for some time and has a temperature reduced when working is started in the morning or afternoon. In such a state, if the viscous fluid is discharged from the discharge nozzle, a smaller amount of the viscous fluid is discharged than usual because a viscosity of the viscous fluid is increased (hardened).

In order to eliminate such drawbacks, for example, a heater is provided on the discharge nozzle to heat the viscous fluid staying in the discharge nozzle to a predetermined temperature. However, an electric cord easily breaks down with the use of the heater. Therefore, it has been desirable that an apparatus capable of heating the viscous fluid with a comparatively simple structure should be implemented.

SUMMARY OF THE INVENTION

It is an object of the present invention to provide a viscous fluid supply control apparatus which can reduce a difference between a primary side pressure of a feeding pump and a secondary side pressure thereof to lessen an internal leak in the feeding pump.

It is another object of the present invention to provide a viscous fluid supply control apparatus which can reduce abrasion of the feeding pump that causes quantitative properties to be deteriorated.

It is a further object of the present invention to provide a viscous fluid supply control apparatus which can suppress a variation in an amount of the discharged viscous fluid with a change in a temperature (usually a reduction in the discharge amount, sometimes an increase in the discharge amount) by using a comparatively simple structure.

A first aspect of the present invention is directed to a viscous fluid supply control apparatus comprising a viscous fluid supply source for supplying a viscous fluid, a discharge nozzle for discharging the viscous fluid, a feeding pump for feeding the viscous fluid from the viscous fluid supply source to the discharge nozzle, a first feeding passage for connecting the viscous fluid supply source to the feeding pump, a second feeding passage for connecting the feeding pump to the discharge nozzle, pressure regulating means provided in the first feeding passage for regulating a feeding pressure of the viscous fluid fed through the first feeding passage, first pressure detecting means for detecting a pressure of the viscous fluid in the first feeding passage, second pressure detecting means for detecting a pressure of the viscous fluid in the second feeding passage, and pressure regulation control means for controlling actuation of the pressure regulating means based on detection values obtained by the first and second pressure detecting means, wherein the pressure regulation control means controls actuation of the pressure regulating means such that a primary side pressure of the feeding pump converges on a secondary side pressure thereof based on the detection values obtained by the first and second pressure detecting means.

According to the present invention, the pressure regulation control means controls the actuation of the pressure regulating means such that the primary side pressure of the feeding pump converges on the secondary side pressure thereof. Consequently, the primary side pressure of the feeding pump and the secondary side pressure thereof are controlled to be almost equal to each other. Therefore, a difference between the primary side pressure of the feeding pump and the secondary side pressure thereof is remarkably reduced, and an internal leak in the feeding pump is lessened. Thus, a bad influence of the internal leak can substantially be eliminated.

A second aspect of the present invention is directed to the viscous fluid supply control apparatus wherein damper means for temporarily storing the viscous fluid in the first feeding passage is provided in the first feeding passage, and an actuation pressure of the damper means is controlled by the pressure regulation control means, thereby keeping pressures of the viscous fluid in the first feeding passage and the damper means substantially equal to each other.

According to the present invention, the damper means is provided in the first feeding passage. Therefore, it is possible to absorb, as required, a fluctuation of the pressure of the viscous fluid in the first feeding passage, for example, a rise in the pressure caused by reverse rotation of the feeding pump and a drop in the pressure caused by rapid normal rotation of the feeding pump which is performed when the discharge of the viscous fluid from the discharge nozzle is started.

A third aspect of the present invention is directed to the viscous fluid supply control apparatus wherein the pressure regulation control means includes a compressed air supply source for supplying compressed air, and air pressure regulating means for regulating a pressure of the compressed air fed from the compressed air supply source to the pressure regulating means and the damper means, the air pressure regulating means regulating the feeding pressure regulated by the pressure regulating means and the actuation pressure of the damper means based on the detection values obtained by the first and second pressure detecting means.

According to the present invention, the actuation of the pressure regulating means and the damper means is controlled by common compressed air, and the feeding pressure obtained by the pressure regulating means and the actuation pressure of the damper means are regulated by the air pressure controlled by the air pressure regulating means. Therefore, they can be controlled comparatively easily.

A fourth aspect of the present invention is directed to the viscous fluid supply control apparatus wherein the second pressure detecting means is provided in the vicinity of a discharge port of the feeding pump.

According to the present invention, the second pressure detecting means is provided in the vicinity of the discharge port of the feeding pump. Therefore, when the viscous fluid is discharged from the discharge nozzle, the change in the pressure of the viscous fluid in the second feeding passage can be detected with high responsibility.

A fifth aspect of the present invention is directed to a viscous fluid supply control apparatus comprising a viscous fluid supply source for supplying a viscous fluid, a discharge nozzle for discharging the viscous fluid, a feeding pump for feeding the viscous fluid from the viscous fluid supply source to the discharge nozzle, a first feeding passage for connecting the viscous fluid supply source to the feeding pump, a second feeding passage for connecting the feeding pump to the discharge nozzle, pressure regulating means provided in the first feeding passage for regulating a feeding pressure of the viscous fluid fed through the first feeding passage, and pump actuation control means for controlling actuation of the feeding pump, wherein the pump actuation control means controls the feeding pump such that rotating force is substantially set to zero in a nozzle closing state in which the viscous fluid is not discharged from the discharge nozzle.

According to the present invention, the pump control means controls the feeding pump such that the rotating force thereof is substantially set to zero in the nozzle closing state. Therefore, the feeding pump is freely rotated by the flow of the viscous fluid caused by the difference between the primary side pressure and the secondary side pressure. Accordingly, the free flow of the viscous fluid from the first feeding passage to the second feeding passage or vice versa is permitted. Consequently, mechanical abrasion of the inside of the feeding pump can remarkably be reduced.

A sixth aspect of the present invention is directed to the viscous fluid supply control apparatus wherein the first feeding passage and the second feeding passage are connected through a bypass passage for bypassing the feeding pump, the bypass passage is provided with a passage switching valve, the passage switching valve being kept open in the nozzle closing state, and the first feeding passage communicates with the second feeding passage through the bypass passage.

According to the present invention, the first feeding passage communicates with the second feeding passage through the bypass passage for bypassing the feeding pump in the closing state of the discharge nozzle. Therefore, if a difference in the pressure between the first feeding passage and the second feeding passage is made, the viscous fluid flows through the bypass passage. Accordingly, the free flow of the viscous fluid from the first feeding passage to the second feeding passage through the bypass passage or vice versa is permitted. Consequently, the mechanical abrasion of the inside of the feeding pump can remarkably be reduced.

A seventh aspect of the present invention is directed to the viscous fluid supply control apparatus wherein the feeding pump is driven and coupled onto an electric motor through a reduction gear, the reduction gear being formed of a ball reduction gear.

According to the present invention, the rotating force sent from the electric motor for rotating the feeding pump is transmitted to the feeding pump through the ball reduction gear. The ball reduction gear has a small starting torque. Therefore, the free rotation of the feeding pump can easily be performed and the rotation performed by the flow of the viscous fluid can easily be permitted.

An eighth aspect of the present invention is directed to a viscous fluid supply control apparatus comprising a viscous fluid supply source for supplying a viscous fluid, a discharge nozzle for discharging the viscous fluid, a feeding pump for feeding the viscous fluid from the viscous fluid supply source to the discharge nozzle, a first feeding passage for connecting the viscous fluid supply source to the feeding pump, a second feeding passage for connecting the feeding pump to the discharge nozzle, pressure regulating means provided in the first feeding passage for regulating a feeding pressure of the viscous fluid fed through the first feeding passage, pump actuation control means for controlling actuation of the feeding pump, a bypass passage for bypassing the feeding pump to connect the first feeding passage to the second feeding passage, and a passage switching valve provided in the bypass passage, wherein the passage switching valve is kept open in a nozzle closing state in which the viscous fluid is not discharged from the discharge nozzle, and the first feeding passage communicates with the second feeding passage through the bypass passage.

According to the present invention, the first feeding passage communicates with the second feeding passage through the bypass passage for bypassing the feeding pump in the closing state of the discharge nozzle. Therefore, if a difference in the pressure between the first feeding passage and the second feeding passage is made, the viscous fluid flows through the bypass passage. Therefore, the free flow of the viscous fluid from the first feeding passage to the second feeding passage through the bypass passage or vice versa is permitted. Consequently, the mechanical abrasion of the inside of the feeding pump can remarkably be reduced.

A ninth aspect of the present invention is directed to the viscous fluid supply control apparatus wherein the pump actuation control means rotates the feeding pump in a direction reverse to a feeding direction such that the pressure of the viscous fluid in the second feeding passage becomes a discharge preparation pressure immediately before the viscous fluid is discharged from the discharge nozzle, thereby making the pressure of the viscous fluid in the second feeding passage lower than a discharge pressure.

According to the present invention, the feeding pump is reversely rotated immediately before the viscous fluid is discharged from the discharge nozzle, and the viscous fluid reversely flows from the second feeding passage toward the first feeding passage. Therefore, the pressure of the viscous fluid in the second feeding passage is reduced and the viscous fluid is kept at the discharge preparation pressure. Thus, it is possible to prevent a large amount of the viscous fluid from being rapidly discharged from the discharge nozzle. Furthermore, the viscous fluid can be kept at the discharge preparation pressure with a simple structure in which the feeding pump is reversely rotated.

A tenth aspect of the present invention is directed to a viscous fluid supply control apparatus comprising a viscous fluid supply source for supplying a viscous fluid, a discharge nozzle for discharging the viscous fluid, a feeding pump for feeding the viscous fluid from the viscous fluid supply source to the discharge nozzle, a first feeding passage for connecting the viscous fluid supply source to, the feeding pump, a second feeding passage for connecting the feeding pump to the discharge nozzle, pressure regulating means provided in the first feeding passage for regulating a feeding pressure of the viscous fluid fed through the first feeding passage, a bypass passage for connecting the first feeding passage to the second feeding passage, and a passage switching valve provided in the bypass passage, wherein the passage switching valve is kept in an opening state during preparation for discharging before the viscous fluid is discharged from the discharge nozzle, and the viscous fluid fed from the first feeding passage to the second feeding passage by actuation of the feeding pump is returned to the first feeding passage through the bypass passage.

According to the present invention, the bypass passage for connecting the first feeding passage to the second feeding passage is caused to communicate during the discharge preparation. Accordingly, the viscous fluid sent from the first feeding passage is fed to the second feeding passage by the actuation of the feeding pump. The viscous fluid thus fed is returned to the first feeding passage through the bypass passage. Thus, a circulating movement of the viscous fluid is caused. By such circulating movement of the viscous fluid, heat sent from the viscous fluid causes a temperature of a portion where the viscous fluid is circulated, that is, the feeding pump or the like to be raised. Thus, it is possible to eliminate disadvantages caused by a reduction in the temperature of the viscous fluid.

An eleventh aspect of the present invention is directed to a viscous fluid supply control apparatus comprising a viscous fluid supply source for supplying a viscous fluid, a discharge nozzle for discharging the viscous fluid, a feeding pump for feeding the viscous fluid from the viscous fluid supply source to the discharge nozzle, a first feeding passage for connecting the viscous fluid supply source to the feeding pump, a second feeding passage for connecting the feeding pump to the discharge nozzle, pressure regulating means provided in the first feeding passage for regulating a feeding pressure of the viscous fluid fed through the first feeding passage, a return passage for connecting the discharge nozzle to the viscous fluid supply source, and a passage switching valve provided in the return passage, wherein the passage switching valve is kept in an opening state during preparation for discharging before the viscous fluid is discharged from the discharge nozzle, and the viscous fluid fed from the first feeding passage to the discharge nozzle through the second feeding passage by actuation of the feeding pump is returned to the viscous fluid supply source through the return passage.

According to the present invention, the return passage for connecting the discharge nozzle to the viscous fluid supply source is caused to communicate during the discharge preparation. Accordingly, the viscous fluid fed from the first feeding passage through the feeding pump and the second feeding passage is returned to the viscous fluid supply source through the return passage. Thus, a circulating movement of the viscous fluid fed from the viscous fluid supply source is caused. By such circulating movement of the viscous fluid, heat sent from the viscous fluid causes temperatures of portions where the viscous fluid is circulated, that is, the first feeding passage, the feeding pump, the second feeding passage, the discharge nozzle and the like to be raised. Thus, it is possible to eliminate disadvantages caused by a reduction in the temperature of the viscous fluid.

A twelfth aspect of the present invention is directed to a viscous fluid supply control apparatus comprising a viscous fluid supply source for supplying a viscous fluid, a discharge nozzle for discharging the viscous fluid, a feeding pump for feeding the viscous fluid from the viscous fluid supply source to the discharge nozzle, a first feeding passage for connecting the viscous fluid supply source to the feeding pump, a second feeding passage for connecting the feeding pump to the discharge nozzle, pressure regulating means provided in the first feeding passage for regulating a feeding pressure of the viscous fluid fed through the first feeding passage, a bypass passage for bypassing the feeding pump to connect the first feeding passage to the second feeding passage, a first passage switching valve provided in the bypass passage, a return passage for connecting the discharge nozzle to the viscous fluid supply source, and a second passage switching valve provided in the return passage, wherein the first and second passage switching valves are kept in an opening state during preparation for discharging before the viscous fluid is discharged from the discharge nozzle, and the viscous fluid fed from the first feeding passage to the second feeding passage through the bypass passage or through the feeding pump and the bypass passage is returned to the viscous fluid supply source through the return passage.

According to the present invention, the bypass passage for connecting the discharge nozzle to the viscous fluid supply source is caused to communicate during the discharge preparation. Accordingly, the viscous fluid fed from the first feeding passage through the bypass passage, or from the first feeding passage through the bypass passage and the feeding pump to the second feeding passage and the discharge nozzle is returned to the viscous fluid supply source through the return passage. Thus, the circulating movement of the viscous fluid fed from the viscous fluid supply source is caused. By such circulating movement of the viscous fluid, heat sent from the viscous fluid causes temperatures of portions where the viscous fluid is circulated, that is, the first feeding passage, the second feeding passage, the discharge nozzle and the like to be raised. Thus, it is possible to eliminate disadvantages caused by a reduction in the temperature of the viscous fluid.

A thirteenth aspect of the present invention is directed to a viscous fluid supply control method in which a feeding pump is provided in a feeding passage for connecting a viscous fluid supply source to a discharge nozzle, and a viscous fluid fed from the viscous fluid supply source is discharged from the discharge nozzle by actuation of the feeding pump, comprising the steps of setting a discharge mode in which the viscous fluid is discharged from the discharge nozzle at a predetermined discharge pressure, a preparation pressure mode in which a discharge preparation pressure that is smaller than the predetermined discharge pressure is set immediately before the viscous fluid is discharged from the discharge nozzle, and a relax mode in which a free flow of the viscous fluid is permitted through the feeding pump, and rotating the feeding pump in a predetermined direction in the discharge mode, and holding rotating force of the feeding pump in a substantial zero state in the relax mode.

According to the present invention, it is possible to set the discharge mode in which the viscous fluid is discharged at the predetermined discharge pressure, the preparation pressure mode for setting the discharge preparation pressure that is lower than the discharge pressure, and the relax mode for permitting the free flow of the viscous fluid. The preparation pressure mode is set immediately before the viscous fluid is discharged from the discharge nozzle. Accordingly, the pressure of the viscous fluid is kept lower than the discharge pressure when the discharge of the viscous fluid from the discharge nozzle is started. Therefore, it is possible to prevent a large amount of the viscous fluid from being discharged at a time when the discharge is started. The relax mode is kept in the closing state of the discharge nozzle. In the relax mode, the rotating force of the feeding pump is kept at substantial zero. Therefore, the free flow of the viscous fluid through the feeding pump is permitted. Consequently, the mechanical abrasion of the inside of the feeding pump can remarkably be reduced.

A fourteenth aspect of the present invention is directed to the viscous fluid supply control method wherein the feeding pump is somewhat rotated in a direction reverse to the predetermined direction in the preparation pressure mode.

According to the present invention, the feeding pump is rotated in the direction reverse to the predetermined direction in the preparation pressure mode. Therefore, the viscous fluid in the second feeding passage is reversely fed toward the first feeding passage. Consequently, the pressure of the viscous fluid in the second feeding passage is made lower than the discharge pressure.

A fifteenth aspect of the present invention is directed to a regulator comprising a housing body, valve means movably provided on one of end sides of the housing body, and piston means movably provided on the other end side of the housing body, wherein a first chamber is defined on one of end sides of the housing body, a second chamber is defined on the other end side, a third chamber is defined between the first chamber and the second chamber, and the first chamber communicates with the third chamber through a communicating path, the valve means includes a valve portion for controlling an amount of a fluid flowing from the first chamber to the third chamber, and a protruding portion extending from the valve portion to the third chamber, the piston means includes a piston portion movably housed in the second chamber, and a working portion extending from the piston portion to the third chamber, the first chamber is provided with a fluid inlet port, the third chamber is provided with a fluid outlet port, and the fluid flowing from the first chamber to the third chamber is controlled by the valve portion of the valve means, a control pressure port is provided on one of sides of the second chamber, and a pressure of the fluid fed from the control pressure port acts on the piston portion of the piston means, and when the pressure of the fluid acting on the control pressure port is increased, the piston means is moved to cause the working portion to decrease a volume of the third chamber so that the fluid in the third chamber is caused to flow out of the fluid outlet port and the working portion then acts on the protruding portion of the valve means, resulting in movement of the valve means together with the piston means so that the fluid fed from the fluid inlet port is caused to flow out of the fluid outlet port through the first chamber, the communicating path and the third chamber.

According to the present invention, the housing body is provided with the valve means and the piston means. The valve means includes the valve portion for controlling the amount of the fluid flowing from the first chamber to the third chamber, and the piston means includes the piston portion to which a control pressure is applied. If the control pressure applied to the piston portion is increased, the working portion of the piston means decreases the volume of the third chamber to first discharge the fluid from the third chamber. Then, the working portion acts on the protruding portion of the valve means. Consequently, the fluid fed from the fluid inlet port is discharged from the fluid outlet port through the first chamber, the communicating path and the third chamber. Accordingly, the control pressure is regulated so that the amount of the fluid flowing from the fluid outlet port can be controlled. Furthermore, the piston means can freely be moved with respect to the valve means. Therefore, when the pressure of the fluid in the third chamber is rapidly raised, the piston means is moved with respect to the valve means. Consequently, the volume of the third chamber is increased so that a rise in the pressure of the fluid can be absorbed.

DESCRIPTION OF THE PREFERRED EMBODIMENTS

Detailed description will be given below with reference to the accompanying drawings.

Figure 1:
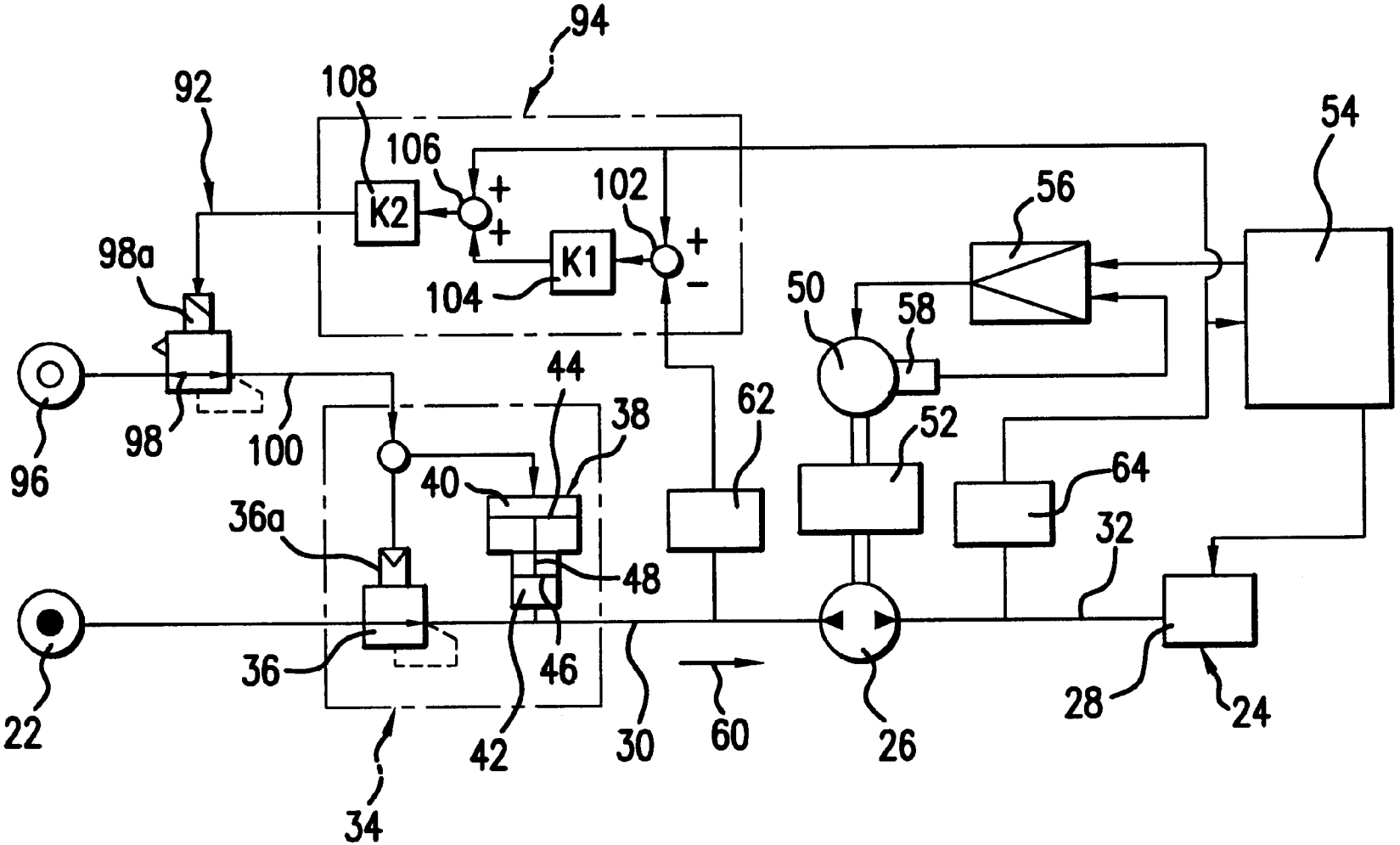
FIG. 1 is a block diagram schematically showing a viscous fluid supply control apparatus according to a first embodiment of the present invention.

FIG. 1 is a block diagram schematically showing a viscous fluid supply control apparatus (which practices a supply control method according to the present invention) according to a first embodiment of the present invention. In FIG. 1, the supply control apparatus which is shown comprises a viscous fluid supply source 22 for supplying a viscous fluid, a discharge nozzle 24 for discharging the viscous fluid, and a feeding pump 26 for feeding the viscous fluid from the viscous fluid supply source 22 to the discharge nozzle 24. The viscous fluid whose supply is controlled by the supply control apparatus may be a coating material or a sealant, for example. By way of example, the viscous fluid supply source 22 is formed by a feeder for feeding a coating material to be applied to a car body, a sealant to be applied to a junction of the car body, and the like. The feeding pump 26 may be a positive displacement pump, preferably a gear pump for feeding the viscous fluid in a predetermined direction by a pair of gears to be rotated in the predetermined direction. The feeding pump 26 is rotated in a predetermined direction (for example, normal rotation) and a direction reverse to the predetermined direction (for example, reverse rotation). The discharge nozzle 24 includes a nozzle body 28 having a discharge port on a tip portion.

The viscous fluid supply source 22 and the feeding pump 26 are connected through a first feeding passage 30, and the feeding pump 26 and the discharge nozzle 24 are connected through a second feeding passage 32. The first feeding passage 30 is provided with a pressure regulating mechanism 34 for regulating an amount of the viscous fluid fed from the viscous fluid supply source 22 to the feeding pump 26, that is, a pressure of the viscous fluid. The pressure regulating mechanism 34 which is shown includes a regulator 36 (forming pressure regulating means) for regulating an amount of the viscous fluid fed through the first feeding passage 30, that is, a feeding pressure of the viscous fluid, and damper means 38 for temporarily storing the viscous a fluid in the first feeding passage 30. Compressed air having a regulated pressure is fed to a pressure port 36*a* of the regulator 36 and a pressure chamber 40 of the damper means 38, which will be described below. Accordingly, the feeding pressure of the viscous fluid fed from the regulator 36 is regulated by an air pressure sent to the pressure port 36*a*. If the air pressure applied to the pressure port 36*a* is raised (or dropped), the feeding pressure of the viscous fluid sent from the regulator 36 is also raised (or dropped). The damper means 38 has a fluid chamber 42 in addition to the pressure chamber 40. The fluid chamber 42 communicates with the first feeding passage 30. A first piston portion 44 is movably provided in the pressure chamber 40, and a second piston portion 46 is movably provided in the fluid chamber 42. The first and second piston portions 44 and 46 are connected through a rod portion 48. Accordingly, a working pressure of the damper means 38, that is, a pressure applied to the fluid in the fluid chamber 42 by the second piston portion 46 is regulated by the air pressure applied to the pressure chamber 40. If the air pressure applied to the pressure chamber 40 is raised (or dropped), a working pressure applied to the fluid in the fluid chamber 42 by the second piston portion 46 is also raised (or dropped).

Such damper means 38 absorbs a rapid change in the pressure of the viscous fluid in the first feeding passage 30. More specifically, when the pressure of the viscous fluid in the first feeding passage 30 is rapidly raised (or dropped) temporarily, force for moving the second piston portion 46 toward the pressure chamber 40 by the viscous fluid in the fluid chamber 42 communicating with the first feeding passage 30 becomes greater (or smaller) than force for moving the first piston portion 44 toward the fluid chamber 42 by the compressed air fed to the pressure chamber 40. Consequently, the first and second piston portions 44 and 46 are moved toward the pressure chamber 40 or the fluid chamber 42 side so that a volume of the fluid chamber 42 is increased (or decreased). Thus, a part of the viscous fluid flows from the first feeding passage 30 (or the fluid chamber 42) into the fluid chamber 42 (or the first feeding passage 30). As a result, the change in the pressure of the viscous fluid in the first feeding passage 30 is absorbed by movement of the first and second piston portions 44 and 46 of the damper means 38 so that the viscous fluid in the first feeding passage 30 is kept at a predetermined pressure without the pressure substantially changed by an external load or the like.

In the present embodiment, the feeding pump 26 is rotated by a servo motor 50. The servo motor 50 is driven and coupled onto the feeding pump 26 through a reduction gear 52. Accordingly, when the servo motor 50 is rotated in a predetermined direction (or a direction reverse to the predetermined direction), the rotating force is transmitted to the feeding pump 26 through the reduction gear 52 so that the feeding pump 26 is normally rotated (or reversely rotated) in the predetermined direction (or the direction reverse to the predetermined direction). When the feeding pump 26 is normally rotated (or reversely rotated), the viscous fluid in the viscous fluid supply source 22 is fed to the second feeding passage 32 (or the first feeding passage 30) through the first feeding passage 30 (or the second feeding passage 32). When the viscous fluid is fed from the feeding pump 26 to a discharge nozzle 24, the viscous fluid is discharged from a discharge port of the discharge nozzle 24 (now shown), which will be described below. For example, in a case where the viscous fluid is a coating material to be applied to a car body, the coating material is discharged toward the car body. In a case where the viscous fluid is a sealant to be applied to a junction of the car body, the sealant is applied to the junction with a predetermined width.

Rotation of the servo motor 50 is controlled by robot control means 54 forming pump actuation control means. An actuation signal is sent from the robot control means 54 to a servo amplifier 56. An output signal is sent from the servo amplifier 56 to the servo motor 50. The rotation of the servo motor 50 is controlled in response to the output signal sent from the servo amplifier 56. A rotating speed detector 58 is provided on the servo motor 50. A detection signal is sent from the rotating speed detector 58 to the servo amplifier 56. An output signal value of the servo amplifier 56 is controlled in response to the detection signal sent from the rotating speed detector 58. The robot control means 54 also controls the switching operation of a discharge port of the discharge nozzle 24. An opening signal (or a closing signal) generated by the robot control means 54 is sent to the discharge nozzle 24. The discharge port of the discharge nozzle 24 is opened (or closed) in response to the opening signal (or the closing signal). Consequently, the viscous fluid fed through the second feeding passage 32 is discharged from the discharge nozzle 24 (the discharge from the discharge nozzle 24 is completed).

In the present embodiment, a discharge mode, a preparation pressure mode and a relax mode can be set by the robot control means 54. When setting the discharge mode, the robot control means 54 generates a normal rotation signal for normally rotating the servo motor 50 and an opening signal for opening the discharge port of the discharge nozzle 24. The normal rotation signal is sent to the servo motor 50 through the servo amplifier 56 so that the servo motor 50 is normally rotated in response to the normal rotation signal. Furthermore, the opening signal is sent to the discharge nozzle 24 so that the discharge port of the discharge nozzle 24 is opened in response to the opening signal. Accordingly, the viscous fluid fed in a feeding direction indicated at an arrow 60 by the normal rotation of the feeding pump 26 is discharged from the discharge port of the discharge nozzle 24 at a required discharge pressure.

When setting the preparation pressure mode, the robot control means 54 generates a reverse rotation signal for reversely rotating the servo motor 50 and a closing signal for closing the discharge port of the discharge nozzle 24. The reverse rotation signal is sent to the servo motor 50 through the servo amplifier 56. The servo motor 50 is reversely rotated in response to the reverse rotation signal. Furthermore, the closing signal is sent to the discharge nozzle 24. The discharge port of the discharge nozzle 24 is closed in response to the closing signal. Accordingly, the viscous fluid is not discharged from the discharge nozzle 24. The viscous fluid is fed from the second feeding passage 32 toward the first feeding passage 30 by the reverse rotation of the feeding pump 26 so that a pressure of the viscous fluid in the second feeding passage 32 is set lower than the discharge pressure.

When setting the relax mode, the robot control means 54 generates a relax signal for stopping supply of a current to the serve motor 50 and the closing signal for closing the discharge port of the discharge nozzle 24. When the relax signal is generated, supply of an electric signal from the robot control means 54 to the servo amplifier 56 is stopped. Consequently, the supply of the current to the servo motor 50 is stopped. When the closing signal is sent to the discharge nozzle 24, the discharge port of the discharge nozzle 24 is closed in response to the closing signal. Accordingly, the viscous fluid is not discharged from the discharge nozzle 24. The rotating force of the feeding pump 26 is substantially set to zero so that the feeding pump 26 is freely rotated by the viscous fluid flowing from the first feeding passage 30 (or the second feeding passage 32) to the second feeding passage 32 (or the first feeding passage 30) based on a pressure difference. Therefore, the viscous fluid does not substantially act as a load to be applied to the feeding pump 26. Consequently, internal abrasion of the feeding pump 26 can remarkably be reduced.

In a case where the relax mode can be set, it is desirable that a ball reduction gear should be used as the reduction gear 52. The ball reduction gear has a small starting torque during transmission of the rotating force from the servo motor 50 to the feeding pump 26, and does not substantially have a self-lock characteristic. Therefore, the driving force can be transmitted lightly with a high efficiency so that the above-mentioned relax mode can easily be set.

A first pressure sensor 62 (forming first pressure detecting means) and a second pressure sensor 64 (forming second pressure detecting means) are provided in the first feeding passage 30 and the second feeding passage 32, respectively. The first pressure sensor 62 detects the pressure of the viscous fluid fed through the first feeding passage 30. The second pressure sensor 64 detects the pressure of the viscous fluid fed through the second feeding passage 32.

Figure 2:
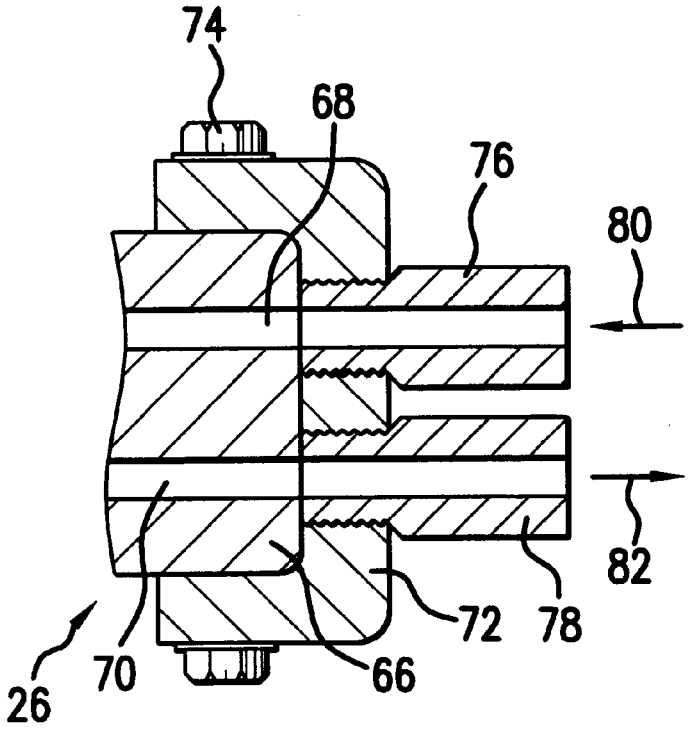
FIG. 2 is a partially enlarged sectional view showing a part of an enlarged feeding pump in the supply control apparatus in FIG. 1.
Figure 3:
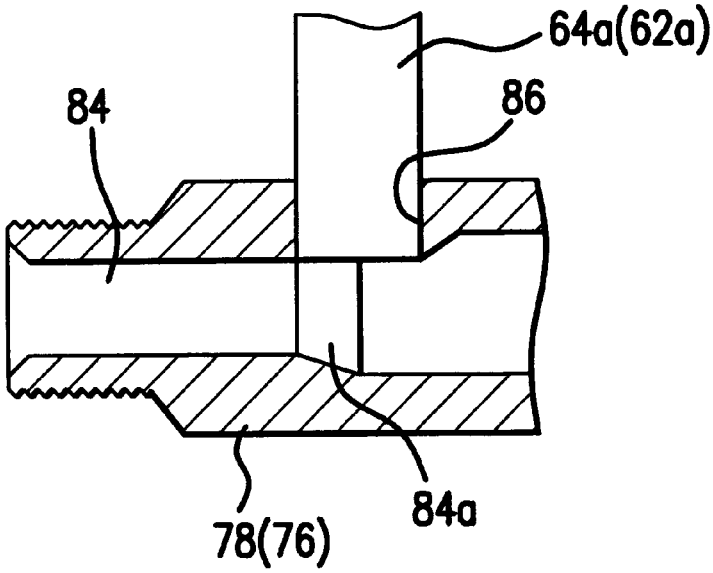
FIG. 3 is a partially enlarged sectional view partially showing a connection member to be connected to the feeding pump and a pressure sensor attached to the connection member.

It is desirable that the first and second pressure sensors 62 and 64 should be provided as shown in FIGS. 2 and 3. Referring to FIGS. 2 and 3, the feeding pump 26 includes a pump body 66. An inlet passage 68 and an outlet passage 70 which communicate with a gear chamber (not shown) are formed on the pump body 66. A pair of pump gears (not shown) are provided in the gear chamber. A mount member 72 is mounted to the pump body 66 with a bolt 74. Tubular connection members 76 and 78 are screwed to the mount member 72. One of end sides of the connection member 76 communicates with the first feeding passage 30, and the other end side communicates with the inlet passage 68 of the pump body 66. One of end sides of the connection member 78 communicates with the second feeding passage 32, and the other end side communicates with the outlet passage 70 of the pump body 66. Accordingly, the viscous fluid fed from the viscous fluid supply source 22 to the first feeding passage 30 is fed to the inlet passage 68 of the feeding pump 26 through the connection member 76 as shown by an arrow 80, and is fed to the gear chamber (not shown) through the inlet passage 68. The viscous fluid supplied from the gear chamber to the outlet passage 70 by the actuation of the pair of pump gears (not shown) is fed to the second feeding passage 32 through the connection member 78 as shown by an arrow 82.

It is desirable that the second pressure sensor 64 should be provided in the vicinity of the outlet passage 70 of the feeding pump 26. In the present embodiment, the second pressure sensor 64 is attached to the connection member 78 as shown in FIG. 3. A passage 84 extending in an axial direction is formed on the connection member 78. A taper portion 84*a* is provided on the almost axially central part of the passage 84. The taper portion 84*a* has an inside diameter gradually increased in a discharge direction. A mount hole 86 is formed on the taper portion 84*a* of the connection member 78. The mount hole 86 extends in a radial direction which is substantially perpendicular to the axial direction. A tip portion 64*a* of the second pressure sensor 64 is attached to the mount hole 86. A tip face of the tip portion 64*a* of the second pressure sensor 64 acts as a pressure detecting face such that the pressure detecting face defines a face which is substantially identical to a face defining the passage 84 of the connection member 78. By the tip face of the second pressure sensor 64 thus provided, the viscous fluid flows smoothly through the connection member 78. Consequently, the viscous fluid can be prevented from staying. Furthermore, the second pressure sensor 64 is provided in the vicinity of the outlet passage 70 of the feeding pump 26, that is, on the connection member 78 in the present embodiment. Thus, a change in the pressure of the viscous fluid can be detected with high responsibility and high precision during the discharge of the viscous fluid from the discharge nozzle 24.

It is desirable that the first pressure sensor 62 should be provided in the vicinity of the inlet passage 68 of the feeding pump 26. In the present embodiment, the first pressure sensor 62 is attached to the connection member 76 in substantially the same manner as the second pressure sensor 64 (see FIG. 3). Thus, a tip portion 62*a* of the first pressure sensor 62 is provided so that the viscous fluid flows smoothly through the connection member 76. The first pressure sensor 62 is provided in the vicinity of the inlet passage 68 of the feeding pump 26, that is, on the connection member 76 in the present embodiment. Consequently, an inlet side pressure of the feeding pump 26, that is, a primary side pressure and an outlet side pressure of the feeding pump 26, that is, a secondary side pressure can be detected with high precision. Thus, supply control of the viscous fluid which will be described below can be performed with high precision.

Referring to FIG. 1 again, detection signals are sent from the first and second pressure sensors 62 and 64 to pressure regulation control means indicated at 92. The pressure regulation control means 92 which is shown includes arithmetic processing means 94 for arithmetically processing the detection signals sent from the first and second pressure sensors 62 and 64 as will be described below, a compressed air supply source 96 for supplying compressed air, and air pressure regulating means 98 for controlling a pressure of the compressed air fed from the compressed air supply source 96 to the pressure regulating mechanism 34. The arithmetic processing means 94 can be included in the robot control means 54.

In the present embodiment, an operation is performed by the arithmetic processing means 94 according to a flowchart which will be described below. An operation signal is sent from the arithmetic processing means 94 to an input portion 98*a* of the air pressure regulating means 98. For example, the compressed air supply source 96 is formed by a compressor. A supply pressure of the compressed air supply source 96 is set higher than a pressure set by the air pressure regulating means 98. The air pressure regulating means 98 is formed by an electropneumatic converter for converting a magnitude of an electric signal to that of an air pressure. Compressed air having a pressure corresponding to an operation value input from the arithmetic processing means 94 to the input portion 98*a* is fed through an air passage 100 to the pressure regulating mechanism 34, that is, the pressure port 36*a* of the regulator 36 and the pressure chamber 40 of the damper means 38. The regulator 36 and the damper means 38 regulates, as required, the pressure of the viscous fluid fed through the first feeding passage 30 corresponding to a pressure of the compressed air fed from the air passage 100, that is, a feeding pressure of the regulator 36 and an actuation pressure of the damper means 38.

Figure 4:
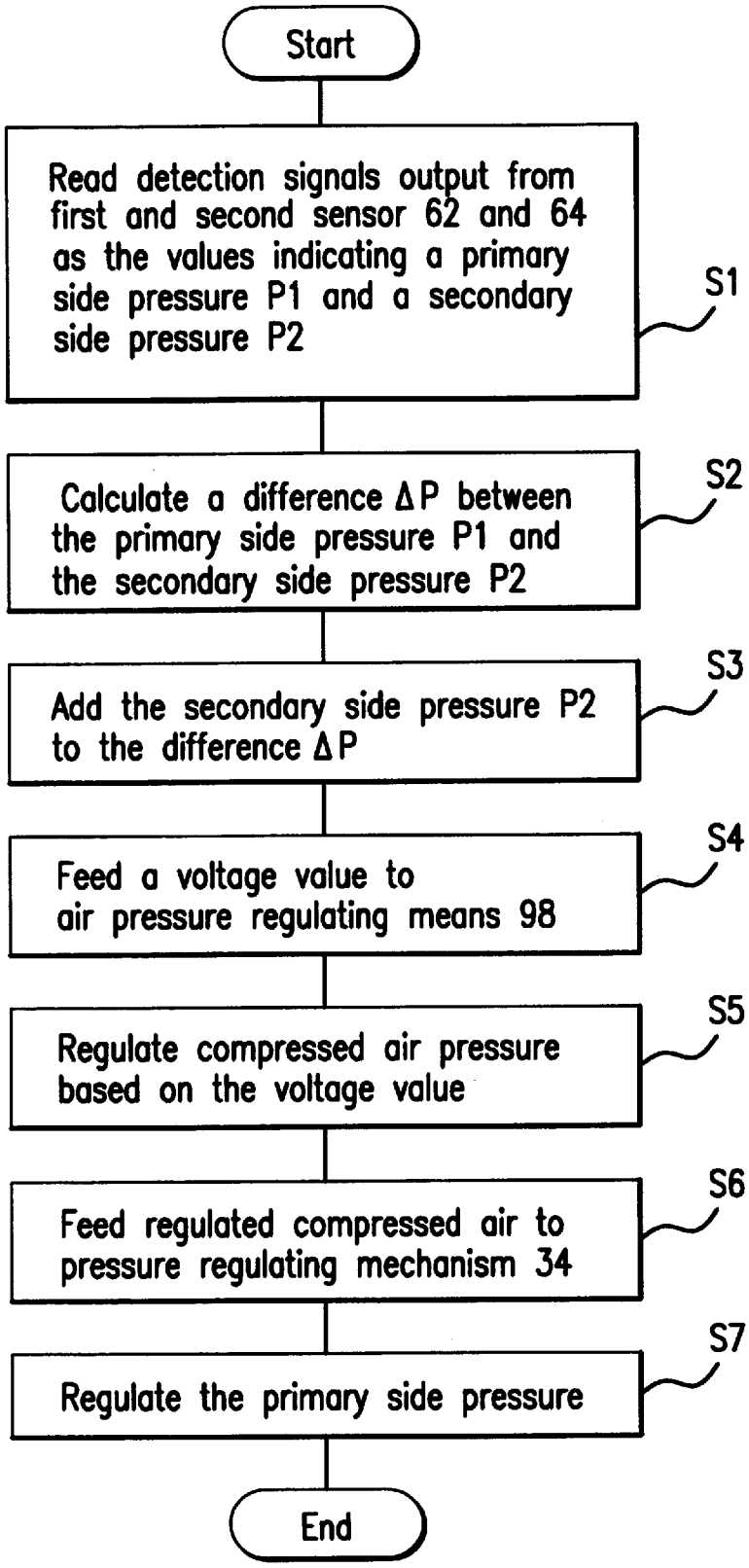
FIG. 4 is a flowchart showing control to be performed by supply control means in FIG. 1.

Next, action of the supply control apparatus mentioned above will be described with reference to FIGS. 4 and 5 in addition to FIG. 1. The detection signals output from the first and second pressure sensors 62 and 64 are sent to the arithmetic processing means 94. The arithmetic processing means 94 arithmetically processes the detection signals according to the flowchart show in FIG. 4. At Step S1, the detection signals output from the first and second pressure sensors (which are detected based on a voltage value corresponding to a pressure value) are read. In the present embodiment, the detection signals are read every 0.03 sec, for example. Accordingly, the flowchart shown in FIG. 4 is executed every 0.03 sec. The detection signal output from the first pressure sensor 62 and the detection signal output from the second pressure sensor 64 are sent to a subtraction point 102 of the arithmetic processing means 94. On the subtraction point 102, a difference ΔP between a secondary side pressure P2 and a primary side pressure P1(ΔP=P2−P1) is calculated (Step S2). The difference ΔP is multiplied by a proportional gain K1 by an arithmetic unit 104. The multiplied difference pressure (K1×ΔP) is sent to an addition point 106. The detection signal is sent from the second pressure sensor 64 to the addition point 106. On the addition point 106, the multiplied difference pressure (K1×ΔP) and the secondary side pressure P2 are added (Step S3). Thus, the secondary side pressure P2 is added to the multiplied difference pressure (K1×ΔP) so that the difference ΔP between the primary side pressure P1 and the secondary side pressure P2 becomes a variable having an absolute pressure value level. A value [P2+(K1×ΔP)] obtained by the addition is multiplied by a proportional gain K2 by an arithmetic unit 108. A value {K2P)[P2 [P (K1(K1P)]} obtained by the multiplication is sent to the input portion 98*a* of the air pressure regulating means 98 (Step S4). When the operation value is thus sent from the arithmetic processing means 94, the routine proceeds to Step S5. The air pressure regulating means 98 regulates a pressure of the compressed air fed through the air passage 100 based on the operation value. The pressure is regulated by controlling the supply of the compressed air fed from the compressed air supply source 96 such that the pressure of the compressed air of the air passage 100 is substantially equal to a pressure corresponding to the operation value sent from the arithmetic processing source 94. While constants of the arithmetic units 104 and 108 are simply set to the proportional gains K1 and K2 in the present embodiment, a primary delay element, a proportional element, a differentiating element, an integrating element and the like can be used in addition to the proportional gains K1 and K2 or in place of the proportional gains K1 and K2 depending on the characteristic of the viscous fluid to be used.

The compressed air whose pressure has been regulated by the air pressure regulating means 98 is sent through the air passage 100 to the pressure regulating mechanism 34, that is, the regulator 36 and the damper means 38. The pressure of the compressed air acts on the input portion 36*a* of the regulator 36 and the pressure chamber 40 of the damper means 38 (Step S6). Thus, the regulator 36 controls the viscous fluid fed from the viscous fluid supply source 22 through the regulator 36 such that the pressure of the viscous fluid fed through the first feeding passage 30 corresponds to the pressure of the compressed air. More specifically, when the pressure of the viscous fluid fed through the first feeding passage 30 is higher (or lower) than the pressure corresponding to the pressure of the compressed air, an amount of the viscous fluid fed through the regulator 36 is reduced (or increased) so that the pressure of the viscous fluid in the first feeding passage 30 is dropped (or raised). The compressed air fed from the air passage 100 acts on the pressure chamber 40 of the damper means 38. Therefore, the actuation pressure of the damper means 38 (which acts on the first piston portion 44) and the fluid pressure of the first feeding passage 30 (which acts on the second piston portion 46) are balanced. Consequently, the damper means 38 is kept well-balanced with the pressure corresponding to the pressure of the compressed air fed through the air passage 100. Thus, the pressure of the viscous fluid fed through the first feeding passage 30, that is, the primary side pressure P1 is regulated (Step S7).

Figure 5:
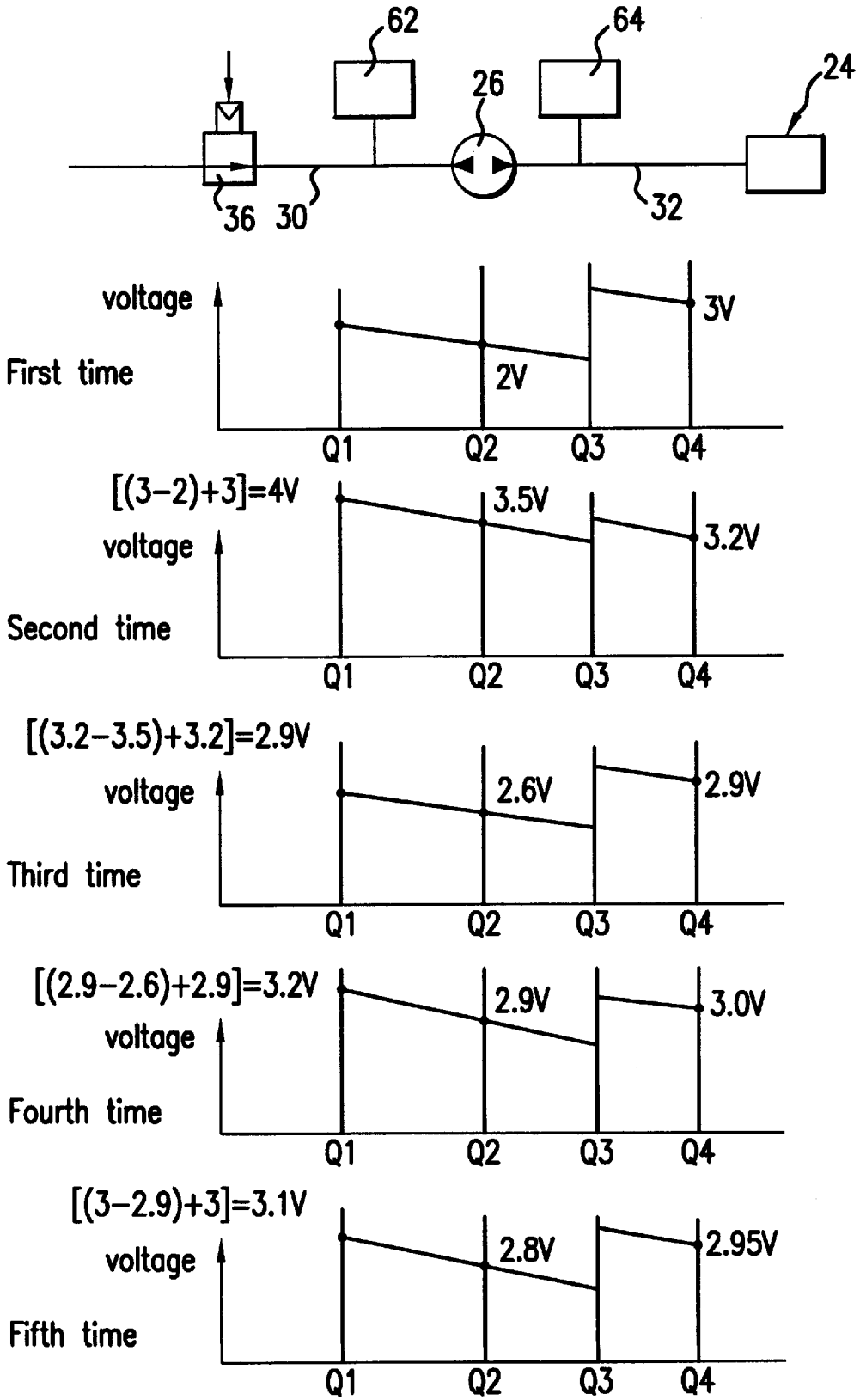
FIG. 5 is a chart showing a state of a fluctuation of a pressure of the viscous fluid in first and second feeding passages provided in the supply control apparatus in FIG. 1.

When the pressure of the viscous fluid is regulated according to the flowchart shown in FIG. 4, the primary side pressure P1 and the secondary side pressure P2 are changed as shown in FIG. 5. For easy explanation, FIG. 5 shows a case where the proportional gains K1 and K2 of the arithmetic units 104 and 108 are set to "1" (K1=K2=1).

In FIG. 5, the first pressure sensor 62 is provided in the first feeding passage 30 extending from the regulator 36 to the feeding pump 26. The pressure of the viscous fluid in the first feeding passage 30 is gradually reduced from the regulator 36 toward the feeding pump 26 by a passage resistance or the like (pressure drop). The second pressure sensor 64 is provided in the second feeding passage 32 extending from the feeding pump 26 to the discharge nozzle 24. The pressure of the viscous fluid in the second feeding passage 32 is gradually reduced from the feeding pump 26 toward the discharge nozzle 24 by a passage resistance or the like. In FIG. 5, Q1 denotes a point where the regulator 36 is provided, Q2 denotes a point where the first pressure sensor 62 is provided, Q3 denotes a point where the feeding pump 26 is provided, and Q4 denotes a point where the second pressure sensor 64 is provided. The pressure of the viscous fluid at the points Q1 to Q4 is indicated by a corresponding voltage value. In a first operation performed by the arithmetic processing means 94, for example, when 2V is read as a pressure value (voltage value) of the first pressure sensor 62 and 3V is read as a pressure value (voltage value) of the second pressure sensor 64, the pressure value (voltage value) to be set by the regulator 36 is set to 4V, for example, as described above. When the pressure value of the regulator 36 is set to 4V, the pressure value of the first pressure sensor 62 is changed to 3.5 V and the pressure value of the second pressure sensor 64 is changed to 3.2 V, for example. The pressure values 3.5 V and 3.2 V are read in a second operation. Consequently, the arithmetic processing means 94 sets the pressure value of the regulator 36 to 2.9 V based on the pressure values of 3.5 V and 3.2 V, for example. Thus, when the pressure value of the regulator 36 is set to 2.9 V (or 3.2 V) in the second (or third) operation, the pressure value of the first pressure sensor 62 is changed to 2.6 V (or 2.9 V) and that of the second pressure sensor 64 is changed to 2.9 V (or 3.0 V), for example. The pressure values of 2.6 V (or 2.9 V) and 2.9 V (or 3.0 V) are read in the third (or fourth) operation. Consequently, the arithmetic processing means 94 sets the pressure value of the regulator 36 to 3.2 V (or 3.1 V) based on the pressure values of 2.6 V (or 2.9 V) and 2.9 V (or 3.0 V), for example. Thus, the pressure of the regulator 36 is controlled. As is easily understood, the pressure of the viscous fluid fed through the first feeding passage 30, that is, the primary side pressure P1 of the feeding pump 26 is controlled so as to converge on and to become substantially equal to the pressure of the viscous fluid fed through the second feeding passage 32, that is, the secondary side pressure P2. Accordingly, the difference between the primary side pressure P1 and the secondary side pressure P2 of the feeding pump 26 is considerably reduced. Consequently, it is possible to remarkably reduce a leak of the viscous fluid caused by the internal leak of the feeding pump 26 (a leak flowing from higher fluid pressure side of the first and second feeding passages 30 and 32 toward lower fluid pressure side of them). It is possible to prevent the bad effect of the internal leak, for example, mechanical abrasion in the feeding pump 26.

In the present embodiment, in a case where the supply control apparatus is not used, that is, the viscous fluid is not discharged from the discharge nozzle, the relax mode is set. In the relax mode, the robot control means 54 generates a relax signal and a closing signal as described above. When the relax signal is generated, supply of an electric signal from the robot control means 54 to the servo amplifier 56 is stopped. Consequently, supply of a current to the servo motor 50 is stopped. When the closing signal is generated, the discharge port of the discharge nozzle 24 is closed in response to the closing signal. Accordingly, the viscous fluid is not discharged from the discharge nozzle 24 and the rotating force of the feeding pump 26 is substantially set to zero. If a difference between the primary side pressure P1 (or the secondary side pressure P2) and the secondary side pressure P2 (or the primary side pressure P1) is made, the viscous fluid flows toward the lower-pressure side by the free rotation of the feeding pump 26.

Before the use of the supply control apparatus is started, that is, the viscous fluid is discharged from the discharge nozzle 24, the preparation pressure mode is set. In the preparation pressure mode, the robot control means 54 generates a reverse rotation signal and a closing signal so that the servo motor 50 is reversely rotated in response to the reverse rotation signal and the discharge port of the discharge nozzle 24 is closed in response to the closing signal as described above. Accordingly, the viscous fluid is not discharged from the discharge nozzle 24. Furthermore, the viscous fluid is fed from the second feeding passage 32 toward the first feeding passage 30 by the reverse rotation of the feeding pump 26, and the pressure of the viscous fluid in the second feeding passage 32 is set to a discharge preparation pressure which is lower than the discharge pressure. When the viscous fluid is reversely fed from the second feeding passage 32 to the first feeding passage 30, the pressure of the viscous fluid in the first feeding passage 30 is somewhat raised. Consequently, the first and second piston portions 44 and 46 of the damper means 38 are moved to the pressure chamber 40 side so that a volume of the fluid chamber 46 is increased. Thus, the reversely supplied viscous fluid flows into the fluid chamber 42 so that a rise in the pressure of the viscous fluid in the first feeding passage 30 is absorbed by action of the damper means 38.

Then, the discharge mode is set for using the supply control apparatus. In the discharge mode, the robot control means 54 generates a normal rotation signal and an opening signal so that the servo motor 50 is normally rotated in response to the normal rotation signal and the discharge port of the discharge nozzle 24 is opened in response to the opening signal. Accordingly, the viscous fluid whose pressure has been regulated as described above is fed to the discharge nozzle 24 by the normal rotation of the feeding pump 26, and is discharged from the discharge port at a required discharge pressure. When the discharge of the viscous fluid is started, the pressure of the viscous fluid in the second feeding passage 32 is kept lower than the discharge pressure. Therefore, a large amount of the viscous fluid can be prevented from being discharged at a time. When the discharge from the discharge nozzle 24 is started, the pressure of the viscous fluid in the second feeding passage 32 tends to be rapidly reduced as is easily understood. In such a case, the viscous fluid which is temporarily stored in the fluid chamber 42 of the damper means 38 is first fed to the second feeding passage 32. Consequently, the pressure of the second feeding passage 32 can be prevented from being rapidly dropped.

The supply control apparatus shown in FIG. 1 can meet the requirements for explosion-proof specification with the following structure, for example. More specifically, a pressure-proof electric motor can be used as the servo motor 50, and pressure sensors meeting the requirement for intrinsically safe specification can be used as the first and second pressure sensors 62 and 64. In addition, the viscous fluid supply source 22, the compressed air supply source 96 and the air pressure regulating means 98 provided outside an explosive danger area can be used for the explosion-proof specification.

Figure 6:
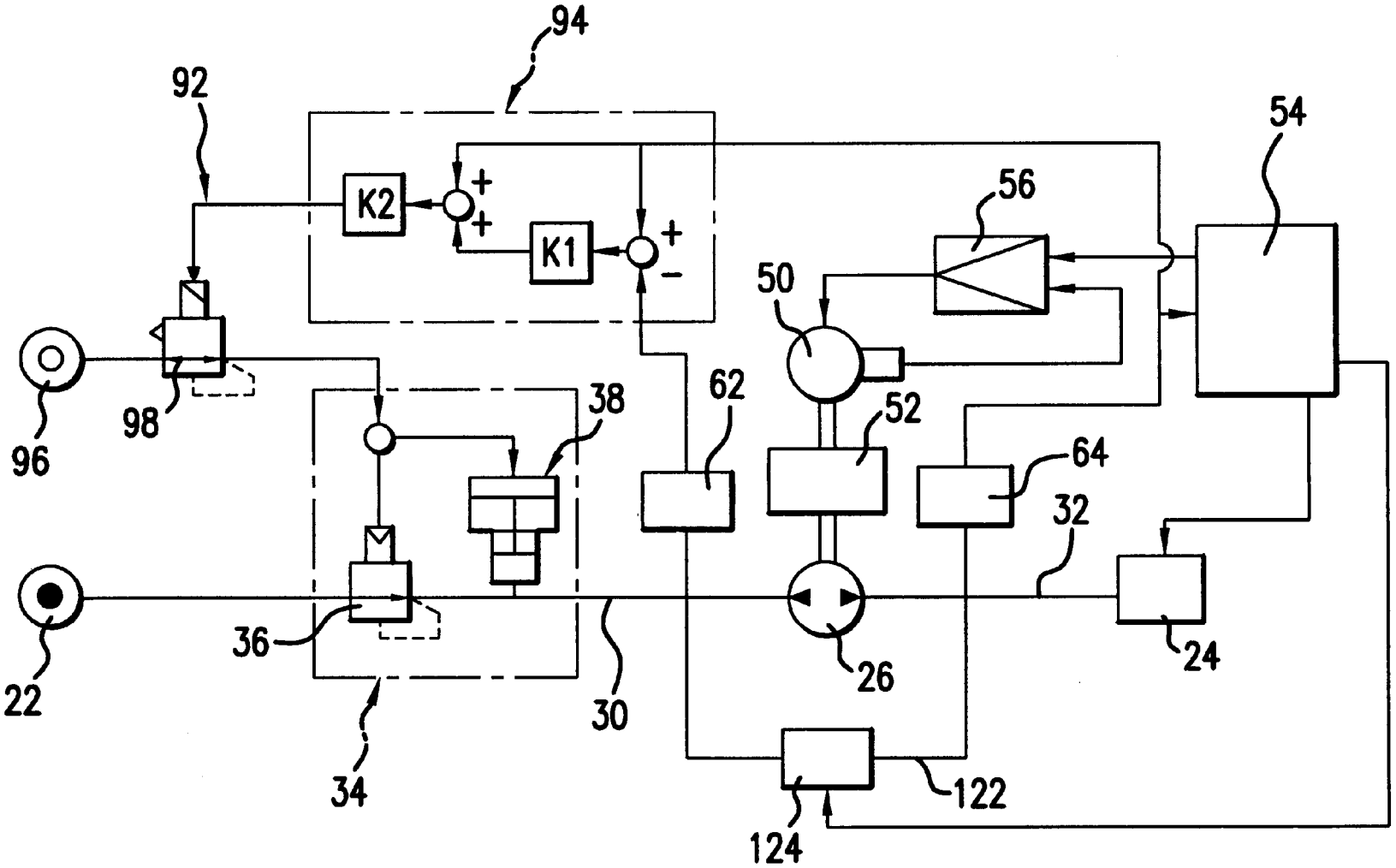
FIG. 6 is a block diagram schematically showing a viscous fluid supply control apparatus according to a second embodiment of the present invention.

FIG. 6 is a block diagram schematically showing a supply control apparatus according to a second embodiment of the present invention. In the supply control apparatus shown in FIG. 6, the substantially same portions have the same reference numerals as in FIG. 1 and their description will be omitted.

Referring to FIG. 6, a bypass passage 122 for bypassing a feeding pump 26 is provided in the second embodiment. One of end sides of the bypass passage 122 is connected to a first feeding passage 30, in more detail, to a portion between a pressure regulating mechanism 34 and the feeding pump 26, and the other end side is connected to a second feeding passage 32, in more detail, to a portion between the feeding pump 26 and a discharge nozzle 24. A switching valve 124 is provided in the bypass passage 122. If the switching valve 124 is kept in an opening state, the first feeding passage 30 communicates with the second feeding passage 32 through the bypass passage 122.

Actuation of the switching valve 124 is controlled in response to a signal sent from robot control means 54. In the present embodiment, when a relax mode is set in the robot control means 54, the robot control means 54 generates a valve opening signal. In response to the valve opening signal, the switching valve 124 is kept in an opening state. In a discharge mode and a preparation pressure mode, the robot control means 54 does not generate the valve opening signal. Consequently, the first feeding passage 30 does not communicate with the second feeding passage 32 through the bypass passage 122. Since other structures according to the second embodiment are substantially identical to those according to the first embodiment shown in FIG. 1, their description will be omitted.

Action according to the second embodiment will be described below. When the relax mode is set in the robot control means 54, the robot control means 54 generates a relax signal and a valve opening signal. When the relax signal is generated, the supply of an electric signal from the robot control means 54 to a servo amplifier 56 is stopped. Consequently, the supply of a current to the servo motor 50 is stopped. When the valve opening signal is generated, the switching valve 124 is kept in the opening state in response to the valve opening signal. Consequently, the first feeding passage 30 communicates with the second feeding passage 32 through the bypass passage 122. Accordingly, the rotating force of the feeding pump 26 is substantially set to zero. Furthermore, the bypass passage 122 is opened. Therefore, if a difference between a primary side pressure P1 (or a secondary side pressure P2) and the secondary side pressure P2 (or the primary side pressure P1) is made, the viscous fluid flows toward the lower-pressure side through the bypass passage 122 by free rotation of the feeding pump 26. Thus, mechanical abrasion in the feeding pump 26 can be prevented. In the second embodiment, the flow of the viscous fluid through the bypass passage 122 can be permitted. Therefore, the viscous fluid can flow more smoothly. In the relax mode, the discharge nozzle 24 is kept in a closing state in the same manner as in the first embodiment.

In the second embodiment, the bypass passage 122 is provided. Therefore, the rotating force of the feeding pump 26 does not need to be substantially kept at zero in the relax mode, but a rotating speed of the feeding pump 26 may be kept at zero. A state in which the rotating speed of the feeding pump 26 is zero can be achieved by supplying a current to the servo motor 50 to keep the rotation thereof in a stop condition, for example.

Figure 7A:
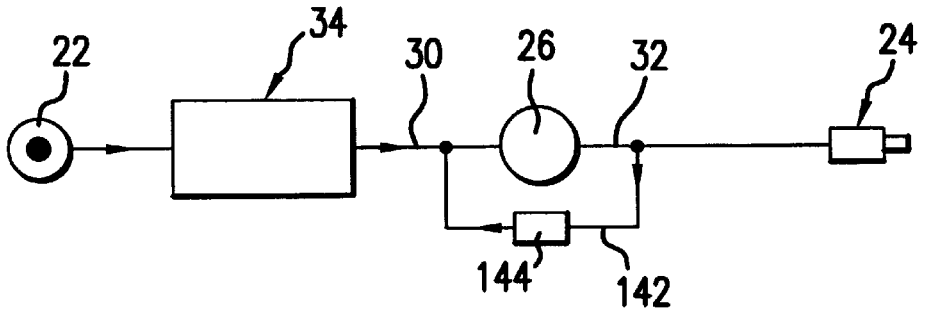
FIGS. 7(*a*), 7(*b*) and 7(*c*) are block diagrams schematically showing a structure for compensating a temperature of a viscous fluid in a second feeding passage, respectively.
Figure 7B:
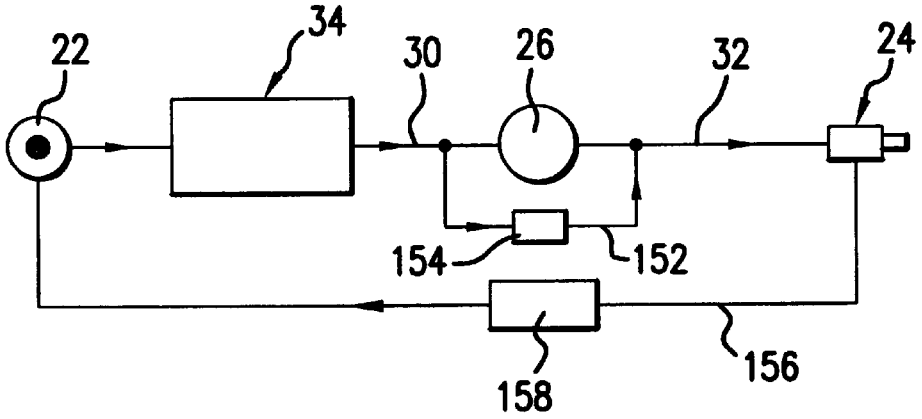
Figure 7C:
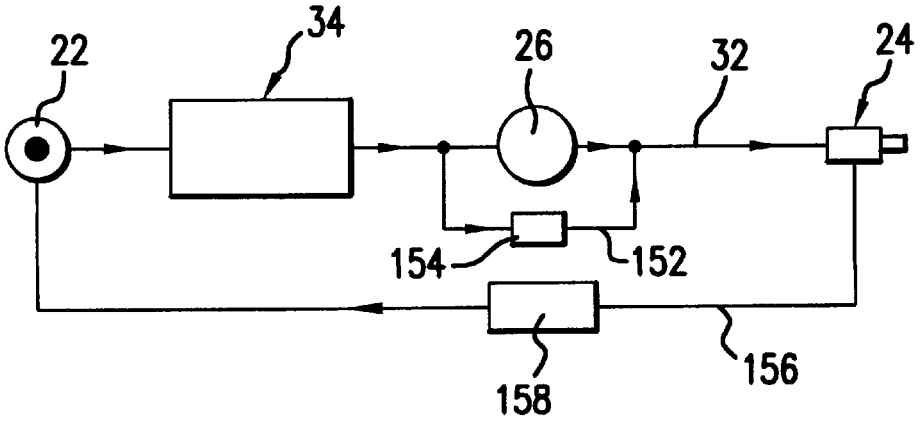

If a temperature of the viscous fluid is changed, flowing characteristics thereof are also varied. For this reason, it is hard to uniformly discharge the viscous fluid from the discharge nozzle 24. Therefore, in a case where the temperature of the viscous fluid is low when working is started, in particular, the temperature of the viscous fluid existing in the second feeding passage 32 is low, it is desirable that the temperature of the viscous fluid should be raised to perform temperature compensation before the discharge of the viscous fluid from the discharge nozzle 24 is started. For example, any of structures shown in FIGS. 7(*a*) to 7(*c*) can be used to raise the temperature of the viscous fluid. In FIGS. 7(*a*) to 7(*c*), the substantially same members as those according to the first embodiment in FIG. 1 have the same reference numerals, and their description will be omitted.

FIG. 7(*a*) shows one form of a structure for performing the temperature compensation. In FIG. 7(*a*), a bypass passage 142 for bypassing the feeding pump 26 is provided in the present embodiment. One of end sides of the bypass passage 142 is connected to the first feeding passage 30, in more detail, to a portion between the pressure regulating mechanism 34 and the feeding pump 26, and the other end side is connected to the second feeding passage 32, in more detail, to a portion between the feeding pump 26 and the discharge nozzle 24. A passage switching valve 144 for opening and closing the bypass passage 142 is provided in the bypass passage 142.

When the discharge is prepared before the viscous fluid is discharged from the discharge nozzle 24, the passage switching valve 144 is kept in an opening state and the feeding pump 26 is normally rotated. Accordingly, the viscous fluid is fed from the first feeding passage 30 to the second feeding passage 32 by the actuation of the feeding pump 26. The viscous fluid fed to the second feeding passage 32 is returned to the first feeding passage 30 through the bypass passage 142. Therefore, the viscous fluid is circulated through the first feeding passage 30, the second feeding passage 32 and the bypass passage 142 as shown by an arrow in FIG. 7(*a*) so that heat of the circulated viscous fluid is transmitted to a portion where the viscous fluid is circulated, that is, the feeding pump 26 or the like so that its temperature is raised. Consequently, the temperature of the viscous fluid in the second feeding passage 32 is also raised so that the viscous fluid is kept at a predetermined temperature. Thus, the temperature of the viscous fluid is compensated. When a discharge port of the discharge nozzle 24 is opened after the discharge is prepared, a predetermined amount of the viscous fluid is discharged from the discharge port because the viscous fluid is kept at the predetermined temperature. As a result, it is possible to eliminate the problem that an insufficient amount of the viscous fluid is discharged due to a drop in the temperature.

As is easily understood by a comparison with FIG. 6, the bypass passage 142 according to the embodiment shown in FIG. 7(*a*) can also be used as a bypass passage capable of setting the relax mode.

FIG. 7(*b*) shows another form of a structure for performing the temperature compensation. In the present embodiment, a return passage for connecting the discharge nozzle 24 to a viscous fluid supply source 22 is further provided in the structure shown in FIG. 7(*a*). According to the present embodiment in FIG. 7(*b*), a bypass passage 152 for bypassing the feeding pump 26 is provided. A first passage switching valve 154 for opening and closing the passage 152 is provided in the bypass passage 152. Furthermore, a return passage 156 is provided. The return passage 156 serves to return the viscous fluid from the discharge nozzle 24 to the viscous fluid supply source 22. One of end sides of the return passage 156 is connected to the discharge nozzle 24, and the other end side thereof is connected to the viscous fluid supply source 22. A second passage switching valve 158 is provided in the return passage 156.

During the discharge preparation before the viscous fluid is discharged from the discharge nozzle 24, the first and second passage switching valves 154 and 158 are held in an opening state (at this time, the feeding pump 26 is not rotated). Accordingly, the viscous fluid supplied from the viscous fluid supply source 22 is fed through the pressure regulating mechanism 34, the first feeding passage 30, the bypass passage 152 and the second feeding passage 32 to the discharge nozzle 24. The viscous fluid fed to the discharge nozzle 24 is returned to the viscous fluid supply source 22 through the return passage 156. Therefore, the viscous fluid is circulated through the pressure regulating mechanism 34, the first feeding passage 30, the bypass passage 152, the second feeding passage 32, the discharge nozzle 24 and the return passage 156 as shown by an arrow in FIG. 7(*b*). Heat of the circulated viscous fluid is transmitted to portions where the viscous fluid is circulated, that is, the pressure regulating mechanism 34, the discharge nozzle 24 and the like, and raises their temperatures. Consequently, a temperature of the viscous fluid in the second feeding passage 32, in particular, that of the viscous fluid in the discharge nozzle 24 is also raised so that the viscous fluid is kept at a predetermined temperature. Thus, the temperature of the viscous fluid is compensated. Consequently, when the discharge port of the discharge nozzle 24 is opened after the discharge preparation, a predetermined amount of the viscous fluid is discharged from the discharge port because the viscous fluid is kept at the predetermined temperature. As a result, it is possible to eliminate the problem that an insufficient amount of the viscous fluid is discharged due to a drop in the temperature. In this form, particularly, the viscous fluid in the discharge nozzle 24 is also circulated. Therefore, the viscous fluid can be held in a preferable state.

As is easily understood by a comparison with FIG. 6, the bypass passage 152 according to the embodiment shown in FIG. 7(*b*) can also be used as a bypass passage capable of setting the relax mode.

According to the embodiment shown in FIG. 7(*b*), the bypass passage 152 is provided to feed the viscous fluid from the first feeding passage 30 to the second feeding passage 32 through the bypass passage 152. Instead, the bypass passage 152 may be omitted and the feeding pump 26 may be rotated normally to feed the viscous fluid from the first feeding passage 30 to the second feeding passage 32 by the action of the feeding pump 26.

FIG. 7(*c*) shows a further form of the structure for performing the temperature compensation. In the present embodiment, a structure is substantially identical to that of FIG. 7(*b*) and actuation is different from that in FIG. 7(*b*). In the form shown in FIG. (c), the first and second passage switching valves 154 and 158 are kept in an opening state when the discharge is prepared before the viscous fluid is discharged from the discharge nozzle 24, and the feeding pump 26 is normally rotated. As shown by an arrow in FIG. 7(*c*), accordingly, the viscous fluid supplied from the viscous fluid supply source 22 is fed through the pressure regulating mechanism 34, the first feeding passage 30 and the bypass passage 152 to the second feeding passage 32, and from the first feeding passage 30 to the second feeding passage 32 by the action of the first feeding pump 26. Then, the viscous fluid is fed from the second feeding passage 32 to the discharge nozzle 24, and is returned to the viscous fluid supply source 22 through a return passage 156. Also in this form, therefore, the viscous fluid is circulated through the pressure regulating mechanism 34, the first feeding passage 30, the bypass passage 152, the feeding pump 26, the second feeding passage 32, the discharge nozzle 24 and the return passage 156. Heat of the circulated viscous fluid is transmitted to portions where the viscous fluid is circulated, that is, the pressure regulating mechanism 34, the feeding pump 26, the discharge nozzle 24 and the like so that their temperatures are raised. Also in this form, accordingly, the temperature of the viscous fluid can be compensated in the same manner as the form shown in FIG. 7(*b*). According to this form, furthermore, the viscous fluid is fed by the action of the feeding pump 26. Therefore, the temperature of the feeding pump 26 can be raised.

As described above, the viscous fluid is circulated when the discharge is prepared before the viscous fluid is discharged in the embodiments shown in FIGS. 7 (*a*) to 7(*c*). Instead, the following structure can also be used. A temperature detecting sensor for detecting a temperature of the viscous fluid can be provided in the second feeding passage 32 or the discharge nozzle 24 to circulate the viscous fluid as described above when a temperature detected by the temperature detecting sensor is equal to or lower than a predetermined temperature.

While the viscous fluid has been circulated in the forms shown in FIGS. 7(*a*) to 7(*c*), the amount of the viscous fluid to be discharged can be compensated with the following structure in place of the circulation or in addition to the circulation. In general, the viscous fluid has a poor fluidity if the temperature is low, and the fluidity is increased as the temperature is raised so that the discharge amount from the discharge nozzle is increased. Therefore, it is desirable that the discharge amount should be reduced as the temperature is raised in order to compensate a fluctuation of the discharge amount with a change in the temperature.

As one of methods for compensating the discharge amount of the viscous fluid, for example, the temperature detecting sensor can be provided in the second feeding passage 32 to regulate a pressure of the viscous fluid in the second feeding passage 32, that is, a discharge pressure of the viscous fluid in response to a detection signal sent from the temperature detecting sensor. In this case, for example, a map setting a relationship between the temperature of the viscous fluid and the pressure of the viscous fluid in the second feeding passage 32 is utilized. The map indicates the relationship between the temperature and the pressure of the viscous fluid. The relationship is set such that the pressure is dropped in a predetermined manner as the temperature is raised. In such a case, a pressure value of the viscous fluid corresponding to a detection temperature value sent from the temperature detecting sensor is read, and regulation is performed such that the pressure of the viscous fluid in the second feeding passage 32 has a value read from the map. In this case, the pressure of the viscous fluid is dropped as the temperature is raised. Consequently, control is performed in a direction in which the amount of the discharged viscous fluid is reduced. Thus, an increase in the discharge amount with a rise in the temperature is compensated.

Instead of the above-mentioned method, the amount of the discharged viscous fluid can be compensated in the following manner, for example. More specifically, the temperature detecting sensor can be provided in the second feeding passage 32 to regulate an opening area of the discharge port of the discharge nozzle 24 or pattern air in response to a detection signal sent from the temperature detecting sensor. In this case, for example, a map setting a relationship between the temperature of the viscous fluid and the opening area of the discharge port of the discharge nozzle 24 is utilized The map indicates the relationship between the temperature and the opening area of the discharge port of the discharge nozzle 24. The relationship is set such that the opening area is reduced in a predetermined manner as the temperature is raised. In such a case, the opening area of the discharge port of the discharge nozzle 24 corresponding to a detection temperature value sent from the temperature detecting sensor is read and is regulated to have a value read from the map. In this case, the opening area of the discharge port of the discharge nozzle 24 is reduced as the temperature is raised. Consequently, the amount of the discharged viscous fluid is controlled so as to be reduced. Thus, an increase in the discharge amount with a rise in the temperature is compensated. In a case where a sealant is discharged as the viscous fluid from the discharge nozzle 24, it is desirable that the opening area of the discharge port should be controlled such that a pattern width of the viscous fluid discharged from the discharge nozzle 24 is constant.

Figure 8:
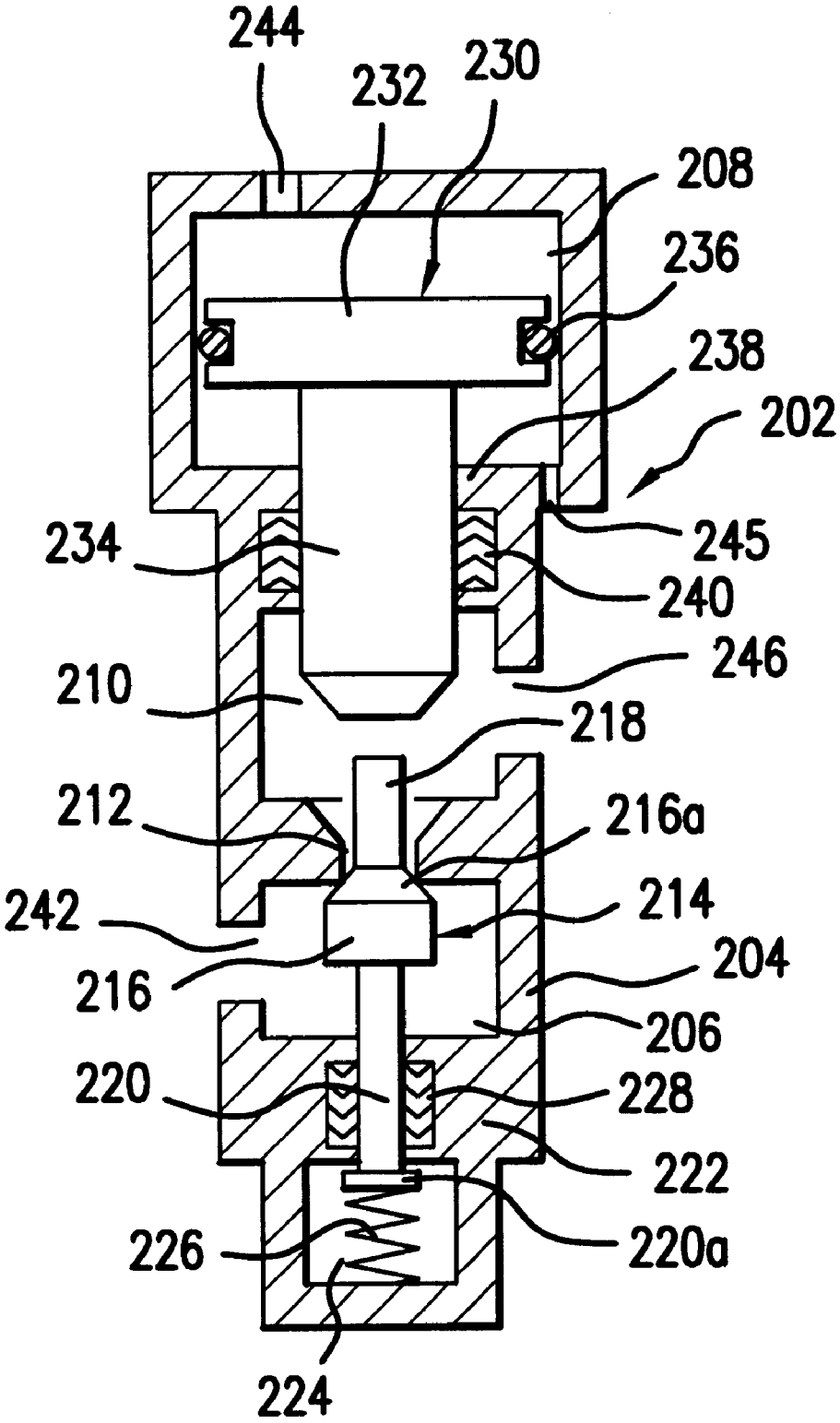
FIG. 8 is a sectional view showing the form of a variant of a regulator.
Figure 9:
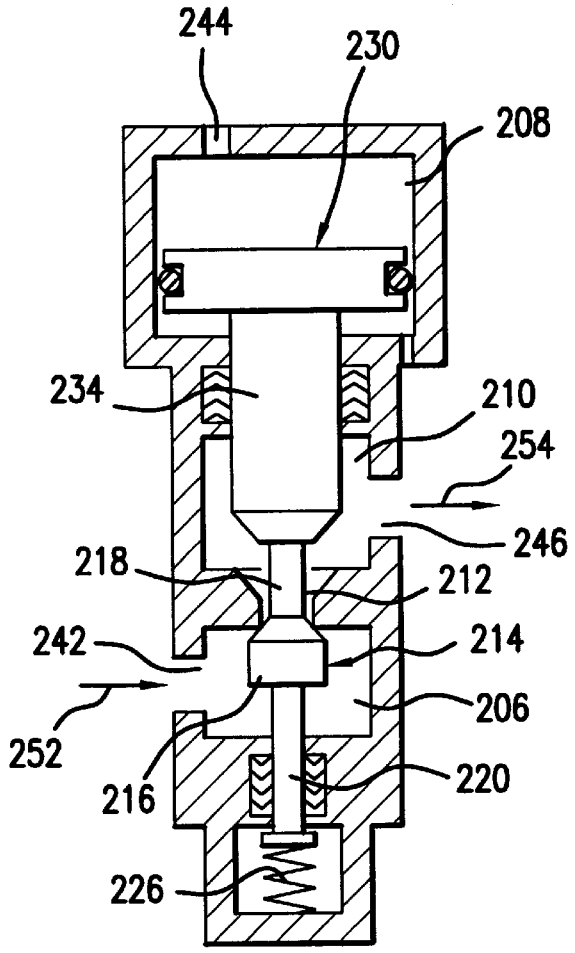
FIG.9 PRIOR ART
FIG. 9 is a sectional view showing the regulator of FIG. 8 in a state in which a communicating path is opened.
Figure 10:
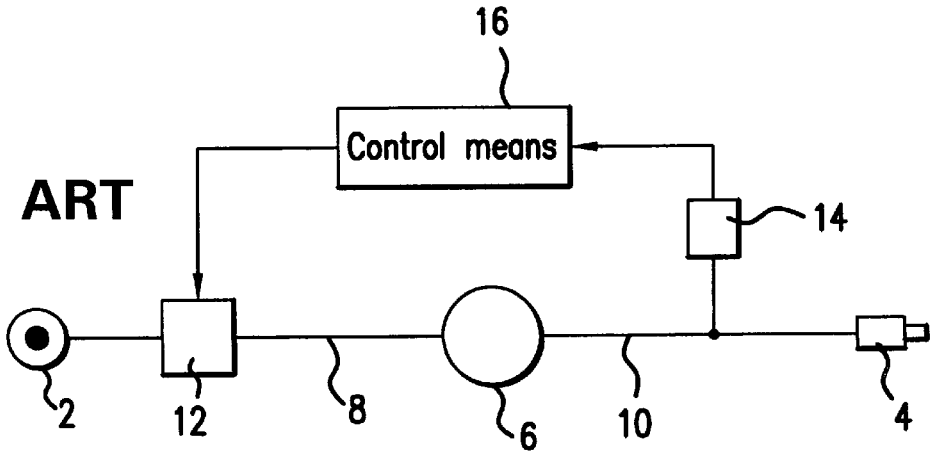
FIG. 10 is a block diagram schematically showing an example of a viscous fluid supply control apparatus according to the prior art.
Figure 11A:
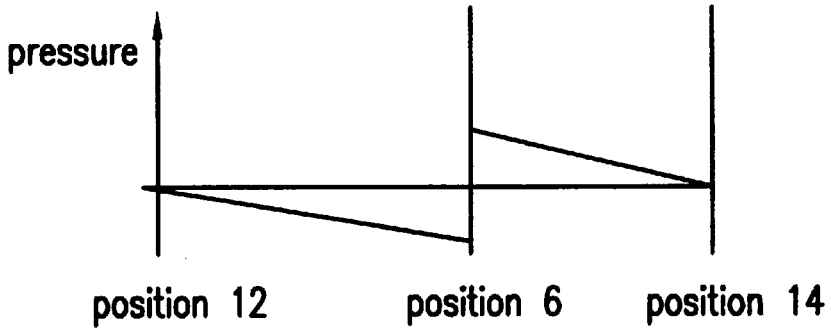
FIG.11a PRIOR ART
FIGS. 11(*a*) and 11(*b*) are charts showing a state of a fluctuation of a pressure of the viscous fluid in the supply control apparatus in FIG. 10, respectively.
Figure 11B:
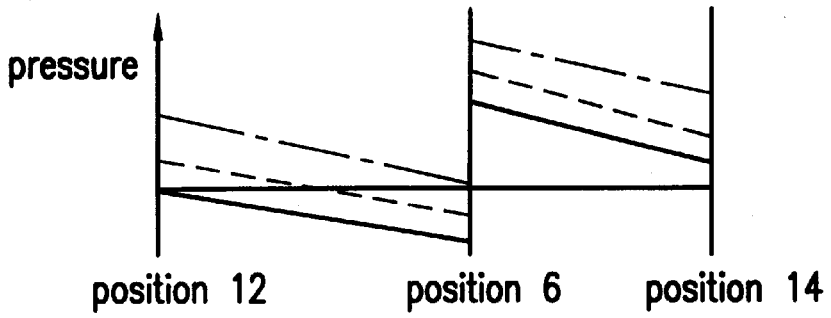

While the pressure control means 34 has been formed by the regulator 36 and the damper means 38 which are provided separately in the first embodiment, a regulator shown in FIGS. 8 and 9 which is obtained by integrally forming them can also be used. Referring to FIGS. 8 and 9, a regulator 202 which is shown includes a housing body 204. One of ends of the housing body 204 has a first chamber 206 defined thereon, the other end thereof has a second chamber 208 defined thereon. A third chamber 210 is defined between the first chamber 206 and the second chamber 208. The first chamber 206 communicates with the third chamber 210 through a communicating path 212.

Valve means 214 is provided in relation to the first chamber 206. The valve means 214 is provided on one of end sides of the housing body 204, and includes a valve portion 216, a protruding portion 218 extending from both ends of the valve portion 216, and a support portion 220. The valve portion 216 is provided in the first chamber 206. A part of the valve portion 216 is provided with a valve portion 216*a* for controlling an amount of a fluid (which may be the viscous fluid) flowing from the first chamber 206 to the communicating path 212. The amount of the flow is controlled with a gap between the valve portion 216*a* and an opening of the communicating path 212. The protruding portion 218 extends from one of ends of the valve portion 216 to the third chamber 210 through the communicating path 212. The support portion 220 extends through a partition wall 222 of the housing body 204 from the other end of the valve portion 216 to a fourth chamber 224 defined on one of ends of the housing body 204. The support portion 220 is movably supported on the partition wall 222 in a vertical direction in FIGS. 8 and 9. Accordingly, the valve means 214 is supported on the partition wall 222 movably in the vertical direction. The fourth chamber 224 is provided with a coil spring 226. The coil spring 226 acts on a tip portion 220*a* of the support portion 220. The coil spring 226 elastically biases the valve means 214 upward in FIG. 8. Consequently, the valve means 214 is kept in a closing state in which the valve portion 216 closes the communicating path 212, that is, a state shown in FIG. 8. Consequently, the flow of the fluid from the first chamber 206 to the communicating path 212 is blocked. A seal member 228 for preventing a leak of the fluid is provided between the partition wall 222 and the support portion 220.

Piston means 230 is provided in relation to the second chamber 208. The piston means 230 includes a piston portion 232 provided in the second chamber 208, and a working portion 234 extending from the piston portion 232. The piston portion 232 is housed in the second chamber 208 movably in the vertical direction. A seal member 236 for sealing a gap with the housing body 204 is attached to a peripheral face of the piston portion 232. The working portion 234 extends from the piston portion 232 to the third chamber 210 through a partition wall 238 of the housing body 204. The working portion 234 is supported on the partition wall 238 movably in the vertical direction in FIGS. 8 and 9. Accordingly, the piston means 230 is supported on the partition wall 238 movably in the vertical direction. A seal member 240 for preventing the leak of the fluid is provided between the partition wall 238 and the working portion 234.

In the present embodiment, a fluid inlet port 242 is formed in the first chamber 206, a control pressure port 244 and an air port 245 are formed in the second chamber 208, and a fluid outlet port 246 is formed in the third chamber 210. In a case where a regulator 202 is applied to the supply control apparatus shown in FIG. 1, for example, the fluid inlet port 242 is connected to the viscous fluid supply source 22, the control pressure port 244 is connected to the air pressure regulating means 98 and the fluid outlet port 246 is connected to the feeding pump 26.

The regulator acts in the following manner. When compressed air is not fed to the second chamber 208 through the control pressure port 244 (or the fed compressed air has a low pressure), the valve means 214 is kept in the closing state shown in FIG. 8 by the action of the coil spring 226 and the fluid fed from the fluid inlet port 242 does not flow into the fluid outlet port 246. At this time, the compressed air does not act on the piston means 230 (or acts on the piston means 230 at a low pressure). Accordingly, the piston means 230 is kept in a state in which it can freely be moved with respect to the housing body 204 (or is kept in a state in which it abuts on the protruding portion 218 of the valve means 214).

In such a state, if the compressed air having a comparatively high pressure is fed through the control pressure port 244, the piston means 230 is moved toward the third chamber 210 by the action of the compressed air so that the working portion 234 of the piston means 230 presses the protruding portion 218 of the valve means 214 downward as shown in FIG. 9. Consequently, the valve means 214 is moved downward against the action of the coil spring 226, and the valve portion 216 gets away from the opening of the communicating path 212 so that the communicating path 212 is opened. Thus, the fluid flowing into the first chamber 206 through the fluid inlet port 242 as shown by an arrow 252 is fed to the third chamber 210 through the communicating path 212, and flows out through the fluid outlet port 246 as shown by an arrow 254.

The fluid in the first chamber 206 acts to move the valve means 214 (and also the piston means 230 when the piston means 230 abuts on the valve means 214) upward, and the fluid in the third chamber 210 acts to move the piston means 230 upward. Accordingly, the valve means 214 is kept in a state in which the force for moving the piston means 230 downward by the compressed air and the force for moving the valve means 214 and the piston means 230 upward by the coil spring 226 and the fluid in the first and third chambers 206 and 210 are balanced, for example, a state shown in FIG. 9. If the force for moving the piston means 230 downward by the compressed air is greater (or smaller) than the force for moving the piston means 230 upward, the piston means 230 and the valve means 214 are moved relatively downward (or upward) with respect to the housing body 204. Consequently, the amount of the fluid flowing from the first chamber 206 to the third chamber 210 is increased (or reduced). Thus, the amount of the fluid flowing through the fluid outlet port 246 is controlled.

In the regulator 202, the valve means 214 and the piston means 230 can be moved independently. Therefore, also in a case where the pressure of the fluid on the downstream side of the third chamber 210 is changed, for example, a fluctuation of the pressure can be absorbed. If the pressure on the downstream side of the third chamber 210 is temporarily raised (or dropped), the fluctuation of the pressure is transmitted to the third chamber 210. When the pressure of the third chamber 210 is raised (or dropped) by the fluctuation of the pressure, the piston means 230 is moved upward (or downward). Consequently, a volume of the third chamber 210 is increased (or decreased). By such a change in the volume of the third chamber 210, the fluctuation of the pressure on the downstream side can be absorbed.

Thus, the conventional regulator and damper means can be formed integrally by using the above-mentioned regulator. Consequently, a structure can be simplified. By regulating the control pressure, the amount of the fluid flowing from the fluid outlet port 246 can be controlled. Furthermore, the piston means 230 can relatively be moved freely with respect to the valve means 214. Therefore, the temporary fluctuation of the pressure on the downstream side of the fluid outlet port 246 can also be absorbed by the movement of the piston means 230.

According to the first aspect of the present invention, the pressure regulation control means controls the actuation of the pressure regulating means such that the primary side pressure of the feeding pump converges on the secondary side pressure thereof. Consequently, the primary side pressure of the feeding pump and the secondary side pressure thereof are controlled to be almost equal to each other. Therefore, a difference between the primary side pressure of the feeding pump and the secondary side pressure thereof is remarkably reduced, and an internal leak in the feeding pump is lessened. Thus, a bad influence of the internal leak can substantially be eliminated.

According to the second aspect of the present invention, the damper means is provided in the first feeding passage. Therefore, it is possible to absorb, as required, a fluctuation of the pressure of the viscous fluid in the first feeding passage, for example, a rise in the pressure caused by reverse rotation of the feeding pump and a drop in the pressure caused by rapid normal rotation of the feeding pump performed when the discharge of the viscous fluid from the discharge nozzle is started.

According to the third aspect of the present invention, the actuation of the pressure regulating means and the damper means is controlled by common compressed air, and the feeding pressure obtained by the pressure regulating means and the actuation pressure of the damper means are regulated by the air pressure controlled by the air pressure regulating means. Therefore, they can be controlled comparatively easily.

According to the fourth aspect of the present invention, a flow sensor having low precision is not used but pressure detecting means is used so that semi-closing loop control can be performed. The second pressure detecting means is provided in the vicinity of the discharge port of the feeding pump. Therefore, when the viscous fluid is discharged from the discharge nozzle, the change in the pressure of the viscous fluid in the second feeding passage can be detected with high responsibility.

According to the fifth aspect of the present invention, the pump control means controls the feeding pump such that the rotating force thereof is substantially set to zero in the nozzle closing state. Therefore, the feeding pump is freely rotated by the flow of the viscous fluid caused by the difference between the primary side pressure and the secondary side pressure. Accordingly, the free flow of the viscous fluid from the first feeding passage to the second feeding passage or vice versa is permitted. Consequently, mechanical abrasion of the inside of the feeding pump can remarkably be reduced.

According to the sixth aspect of the present invention, the first feeding passage communicates with the second feeding passage through the bypass passage for bypassing the feeding pump in the closing state of the discharge nozzle. Therefore, if a difference in the pressure between the first feeding passage and the second feeding passage is made, the viscous fluid flows through the inside of the feeding pump and the bypass passage. Consequently, the free flow of the viscous fluid from the first feeding passage to the second feeding passage through the feeding pump and the bypass passage or vice versa is permitted. As a result, the mechanical abrasion of the inside of the feeding pump can remarkably be reduced.

According to the seventh aspect of the present invention, the rotating force sent from the electric motor for rotating the feeding pump is transmitted to the feeding pump through the ball reduction gear. The ball reduction gear has a small starting torque. Therefore, the free rotation of the feeding pump can easily be performed and the rotation performed by the flow of the viscous fluid can easily be permitted.

According to the eighth aspect of the present invention, the first feeding passage communicates with the second feeding passage through the bypass passage for bypassing the feeding pump in the closing state of the discharge nozzle. Therefore, if a difference in the pressure between the first feeding passage and the second feeding passage is made, the viscous fluid flows through the bypass passage. Therefore, the free flow of the viscous fluid from the first feeding passage to the second feeding passage through the bypass passage or vice versa is permitted. Consequently, the mechanical abrasion of the inside of the feeding pump can remarkably be reduced.

According to the ninth aspect of the present invention, the feeding pump is reversely rotated immediately before the viscous fluid is discharged from the discharge nozzle, and the viscous fluid reversely flows from the second feeding passage toward the first feeding passage. Therefore, the pressure of the viscous fluid in the second feeding passage is reduced and the viscous fluid is kept at the discharge preparation pressure. Thus, a large amount of the viscous fluid obtained by adding an expansion in the second feeding passage to an ordinarily constant amount of supply can be prevented from being rapidly discharged from the discharge nozzle. Consequently, a material is not wasted. Furthermore, the viscous fluid can be kept at the discharge preparation pressure with a simple structure in which the feeding pump is reversely rotated without spray-dumping regulation. Thus, great advantages can be obtained in respect of environment.

In that case, furthermore, the pressures of the first feeding passage and the second feeding passage are balanced. Therefore, even if a volume efficiency of the feeding pump is deteriorated, the discharge preparation pressure can be kept.

According to the tenth aspect of the present invention, the bypass passage for connecting the first feeding passage to the second feeding passage is caused to communicate during the discharge preparation. Accordingly, the viscous fluid sent from the first feeding passage is fed to the second feeding passage by the action of the feeding pump. The viscous fluid thus fed is returned to the first feeding passage through the bypass passage. Thus, the circulating movement of the viscous fluid is caused. By such circulating movement of the viscous fluid, heat sent from the viscous fluid causes a temperature of a portion where the viscous fluid is circulated, that is, the feeding pump or the like to be raised. Thus, it is possible to eliminate disadvantages caused by a reduction in the temperature of the viscous fluid.

According to the eleventh aspect of the present invention, the return passage for connecting the discharge nozzle to the viscous fluid supply source is caused to communicate during the discharge preparation. Accordingly, the viscous fluid fed from the first feeding passage through the feeding pump and the second feeding passage is returned to the viscous fluid supply source through the return passage. The circulating movement of the viscous fluid fed from the viscous fluid supply source is caused. By such circulating movement of the viscous fluid, heat sent from the viscous fluid causes temperatures of portions where the viscous fluid is circulated, that is, the first feeding passage, the feeding pump, the second feeding passage, the discharge nozzle and the like to be raised. Thus, it is possible to eliminate disadvantages caused by a reduction in the temperature of the viscous fluid.

According to the twelfth aspect of the present invention, the bypass passage for connecting the discharge nozzle to the viscous fluid supply source is caused to communicate during the discharge preparation. Accordingly, the viscous fluid fed from the first feeding passage through the bypass passage, or from the first feeding passage through the bypass passage and the feeding pump to the second feeding passage and the discharge nozzle is returned to the viscous fluid supply source through the return passage. Thus, the circulating movement of the viscous fluid fed from the viscous fluid supply source is caused. By such circulating movement of the viscous fluid, heat sent from the viscous fluid causes temperatures of portions where the viscous fluid is circulated, that is, the first feeding passage, the second feeding passage, the discharge nozzle and the like to be raised. Thus, it is possible to eliminate disadvantages caused by a reduction in the temperature of the viscous fluid.

According to the thirteenth aspect of the present invention, it is possible to set the discharge mode in which the viscous fluid is discharged at a predetermined discharge pressure, the preparation pressure mode for setting the discharge preparation pressure that is lower than the discharge pressure, and the relax mode for permitting the free flow of the viscous fluid. The preparation pressure mode is set immediately before the viscous fluid is discharged from the discharge nozzle. Accordingly, the pressure of the viscous fluid is kept lower than the discharge pressure when the discharge of the viscous fluid from the discharge nozzle is started. Therefore, it is possible to prevent a large amount of the viscous fluid from being discharged at a time when the discharge is started. The relax mode is kept in the closing state of the discharge nozzle. In the relax mode, the rotating force of the feeding pump is kept at substantial zero. Therefore, the free flow of the viscous fluid through the feeding pump is permitted. Consequently, the mechanical abrasion of the inside of the feeding pump can remarkably be reduced.

According to the fourteenth aspect of the present invention, the feeding pump is rotated in the direction reverse to the predetermined direction in the preparation pressure mode. Therefore, the viscous fluid in the second feeding passage is reversely fed toward the first feeding passage. Consequently, the pressure of the viscous fluid in the second feeding passage is made lower than the discharge pressure.

According to the fifteenth aspect of the present invention, the housing body is provided with the valve means and the piston means. The valve means includes the valve portion for controlling the amount of the fluid flowing from the first chamber to the third chamber, and the piston means includes the piston portion to which a control pressure is applied. If the control pressure applied to the piston portion is increased, the working portion of the piston means decreases the volume of the third chamber to first supply the fluid stored in the third chamber. Then, the working portion further acts on the protruding portion of the valve means. Consequently, the fluid fed from the fluid inlet port is discharged from the fluid outlet port through the first chamber, the communicating path and the third chamber. Accordingly, the control pressure is regulated so that the amount of the fluid flowing from the fluid outlet port can be controlled. Furthermore, the piston means can freely be moved with respect to the valve means. Therefore, when the pressure of the fluid in the third chamber is rapidly raised, the piston means is moved with respect to the valve means. Consequently, the volume of the third chamber is increased so that a rise in the pressure of the fluid can be absorbed.

Although the present invention has fully been described by way of example with reference to the accompanying drawings, it is to be understood that various changes and modifications will be apparent to those skilled in the art. Therefore, unless otherwise stated such changes and modifications do not depart from the scope of the invention and should be construed as being included therein.

What is claimed is:

1. A viscous fluid supply control apparatus comprising:

a viscous fluid supply source that supplies a viscous fluid;

a discharge nozzle that discharges the viscous fluid;

a feeding pump that feeds the viscous fluid from the viscous fluid supply source to the discharge nozzle;

a first feeding passage for connecting the viscous fluid supply source to the feeding pump;

a second feeding passage that connects the feeding pump to the discharge nozzle;

pressure regulation means provided in the first feeding passage for regulating a feeding pressure to the viscous fluid fed through the first feeding passage;

first pressure detecting means for detecting a pressure of the viscous fluid in the first feeding passage;

second pressure detecting means for detecting a pressure of the viscous fluid in the second feeding passage; and pressure regulation control means for controlling actuation of the pressure regulating means based on detection values obtained by the first and second pressure detecting means, wherein the pressure regulation control means controls actuation of the pressure regulating means such that a primary side pressure of the feeding pump converges on a secondary side pressure thereof based on the detection values obtained by the first and second pressure detecting means and, wherein a damper means for temporarily storing the viscous fluid in the first feeding passage is provided in the first feeding passage, and an actuation pressure of the damper means is controlled by the pressure regulation control means, thereby keeping pressures of the viscous fluid in the first feeding passage and the damper means substantially equal to each other.

2. The viscous fluid supply control apparatus according to Claim 1, wherein the pressure regulation control means includes a compressed air supply source for supplying compressed air, and air pressure regulating means for regulating a pressure of the compressed air fed from the compressed air supply source to the pressure regulating means and the damper means, the air pressure regulating means regulating the feeding pressure regulated control by the pressure regulating means and the actuation pressure of the damper means based on the detection values obtained by the first and second pressure detecting means.

3. The viscous fluid supply control apparatus according to claim 2, wherein the pump comprises a discharge and the second pressure detecting means is provided in the vicinity of the discharge port of the feeding pump.

4. The viscous fluid supply control apparatus according to claim 1, wherein the pump comprises a discharge and the second pressure detecting means is provided in the vicinity of the discharge port of the feeding pump.

5. A viscous fluid supply control apparatus comprising:

a viscous fluid supply source that supplies a viscous fluid;

a discharge nozzle that discharges the viscous fluid;

a feeding pump that feeds the viscous fluid from the viscous fluid supply source to the discharge nozzle;

a first feeding passage that connects the viscous fluid supply source to the feeding pump;

a second feeding passage that connects the feeding pump to the discharge nozzle;

pressure regulating means provided in the first feeding passage for regulating a feeding pressure of the viscous fluid fed through the first feeding passage; and pump actuation control means for controlling actuation of the feeding pump, wherein the pump actuation control means controls the feeding pump such that a rotating force of the feeding pump is substantially set to zero in a nozzle closing state in which the viscous fluid is not discharged from the discharge nozzle.

6. The viscous fluid supply control apparatus according to claim 5, wherein the first feeding passage and the second feeding passage are connected through a bypass passage for bypassing the feeding pump, the bypass passage is provided with a passage switching valve, the passage switching valve being kept open in the nozzle closing state, and the first feeding passage communicates with the second feeding passage through the bypass passage.

7. The viscous fluid supply control apparatus according to claim 6, wherein the feeding pump is driven and coupled onto an electric motor through a reduction gear, the reduction gear being formed of a ball reduction gear.

8. The viscous fluid supply control apparatus according to claim 5 wherein the feeding pump is driven and coupled onto an electric motor through a reduction gear, the reduction gear being formed of a ball reduction gear.

9. The viscous fluid supply control apparatus of claim 5, wherein the pump actuation control means rotates the feeding pump in a direction reverse to a feeding direction such that the pressure of the viscous fluid in the second feeding passage becomes a discharge preparation pressure immediately before the viscous fluid is discharged from the discharge nozzle, thereby making the pressure of the viscous fluid in the second feeding passage lower than a discharge pressure.

10. A viscous fluid supply control apparatus comprising:

a viscous fluid supply source that supplies a viscous fluid;

a discharge nozzle that discharges the viscous fluid;

a feeding pump that feeds the viscous fluid from the viscous fluid supply source to the discharge nozzle;

a first feeding passage that connects the viscous fluid supply source to the feeding pump;

a second feeding passage that connects the feeding pump to the discharge nozzle;

pressure regulating means provided in the first feeding passage for regulating a feeding pressure of the viscous fluid fed through the first feeding passage;

pump actuation control means for controlling actuation of the feeding pump;

a bypass passage that bypasses the feeding pump to connect the first feeding passage to the second feeding passage; and a passage switching valve provided in the bypass passage, wherein the passage switching valve is kept open in a nozzle closing state in which the viscous fluid is not discharged from the discharge nozzle, and the first feeding passage communicates with the second feeding passage through the bypass passage.

11. The viscous fluid supply control apparatus of claim 10, herein the pump actuation control means rotates the feeding pump in a direction reverse to a feeding direction such that the pressure of the viscous fluid in the second feeding passage becomes a discharge preparation pressure immediately before the viscous fluid is discharged from the discharge nozzle, thereby making the pressure of the viscous fluid in the second feeding passage lower than a discharge pressure.

12. A viscous fluid supply control apparatus comprising:

a viscous fluid supply source that supplies a viscous fluid;

a discharge nozzle that discharges the viscous fluid;

a feeding pump that feeds the viscous fluid from the viscous fluid supply source to the discharge nozzle;

a first feeding passage for connecting the viscous fluid supply source to the feeding pump;

a second feeding passage that connects the feeding pump to the discharge nozzle;

pressure regulation means provided in the first feeding passage for regulating a feeding pressure to the viscous fluid fed through the first feeding passage;

first pressure detecting means for detecting a pressure of the viscous fluid in the first feeding passage;

second pressure detecting means for detecting a pressure of the viscous fluid in the second feeding passage; and pressure regulation control means for controlling actuation of the pressure regulating means based on detection values obtained by the first and second pressure detecting means, wherein the pressure regulation control means controls actuation of the pressure regulating means such that a primary side pressure of the feeding pump converges on a secondary side pressure thereof based on the detection values obtained by the first and second pressure detecting means and, wherein the pump actuation control means rotates the feeding pump in a direction reverse to a feeding direction such that the pressure of the viscous fluid in the second feeding passage becomes a discharge preparation pressure immediately before the viscous fluid is discharged from the discharge nozzle, thereby making the pressure of the viscous fluid in the second feeding passage lower than a discharge pressure.

13. A viscous fluid supply control apparatus comprising:

a viscous fluid supply source that supplies a viscous fluid;

a discharge nozzle that discharges the viscous fluid;

a feeding pump that feeds the viscous fluid from the viscous fluid supply source to the discharge nozzle;

a first feeding passage that connects the viscous fluid supply source to the feeding pump;

a second feeding passage that connects the feeding pump to the discharge nozzle;

pressure regulating means provided in the first feeding passage for regulating a feeding pressure of the viscous fluid fed through the first feeding passage;

a bypass passage that connects the first feeding passage to the second feeding passage; and a passage switching valve provided in the bypass passage, wherein the passage switching valve is kept in an opening state during preparation for discharging before the viscous fluid is discharged from the discharge nozzle, and the viscous fluid fed from the first feeding passage to the second feeding passage by actuation of the feeding pump is returned to the first feeding passage through the bypass passage.

14. A viscous fluid supply control apparatus comprising:

a viscous fluid supply source that supplies a viscous fluid;

a discharge nozzle that discharges the viscous fluid;

a feeding pump that feeds the viscous fluid from the viscous fluid supply source to the discharge nozzle;

a first feeding passage that connects the viscous fluid supply source to the feeding pump;

a second feeding passage that connects the feeding pump to the discharge nozzle;

pressure regulating means provided in the first feeding passage for regulating a feeding pressure of the viscous fluid fed through the first feeding passage;

a return passage for connecting the discharge nozzle to the viscous fluid supply source; and a passage switching value provided in the return passage, wherein the passage switching valve is kept in an opening state during preparation for discharging before the viscous fluid is discharged from the discharge nozzle, and the viscous fluid fed from the first feeding passage to the discharge nozzle through the second feeding passage by the actuation of the feeding pump is returned to the viscous fluid supply source through the return passage.

15. A viscous fluid supply control apparatus comprising:

a viscous fluid supply source that supplies a viscous fluid;

a discharge nozzle that discharges the viscous fluid;

a feeding pump that feeds the viscous fluid form the viscous fluid supply source to the discharge nozzle;

a first feeding passage that connects the viscous fluid supply source to the feeding pump;

a second feeding passage that connects the feeding pump to the discharge nozzle;

pressure regulating means provided in the first feeding passage for regulating a feeding pressure of the viscous fluid fed through the first feeding passage;

a bypass passage that bypasses the feeding pump to connect the first feeding passage to the second feeding passage;

a first passage switching value provided in the bypass passage;

a return passage that connects the discharge nozzle to the viscous fluid supply source; and a second passage switching valve provided in the return passage, wherein the first and second passage switching valves are kept in an opening state during preparation for discharging before the viscous fluid is discharged from the discharge nozzle, and the viscous fluid fed from the first feeding passage to the second feeding passage through the bypass passage or through the feeding pump and the bypass passage is returned to the viscous fluid supply source through the return passage.

16. A viscous fluid supply control method in which a feeding pump is provided in a feeding passage for connecting a viscous fluid supply source to a discharge nozzle, and a viscous fluid fed from the viscous fluid supply source is discharged from the discharge nozzle by actuation of the feeding pump, comprising the steps of:

setting a discharge mode during which the viscous fluid is discharged from the discharge nozzle at a predetermined discharge pressure;

setting a preparation pressure mode during which a discharge preparation pressure that is smaller than the predetermined discharge pressure is set immediately before the viscous fluid is discharged from the discharge nozzle;

setting a relax mode during which a free flow of the viscous fluid is permitted through the feeding pump;

rotating the feeding pump in a predetermined direction during the discharge mode; and holding a rotating force of the feeding pump in a substantial zero state during the relax mode.

17. The viscous fluid supply control method according to claim 16, wherein the feeding pump is rotated in a direction opposite to the predetermined direction in the preparation pressure mode.

* * * * *